United States Patent [19]

Nolte et al.

[11] Patent Number: 4,879,862

[45] Date of Patent: Nov. 14, 1989

[54] PROCESS FOR AUTOMATICALLY PACKAGING LETTER ENVELOPES AND MAILING WALLETS INTO A CONTAINER AND AUTOMATIC PACKAGING MACHINE FOR CARRYING OUT THE PROCESS

[75] Inventors: Bert Nolte, Kirchheim; Siegfried Leonhardt, Stuttgart, both of Fed. Rep. of Germany

[73] Assignee: Otto Ficker AG, Kirchheim/Teck, Fed. Rep. of Germany

[21] Appl. No.: 130,372

[22] Filed: Dec. 8, 1987

[30] Foreign Application Priority Data

Dec. 8, 1986 [DE] Fed. Rep. of Germany ..... 3641859

[51] Int. Cl.[4] ..... B65B 57/20; B65B 35/30

[52] U.S. Cl. ..... 53/438; 53/247; 53/443; 53/542

[58] Field of Search ..... 53/443, 438, 436, 542, 53/540, 529, 247

[56] References Cited

U.S. PATENT DOCUMENTS

| | | | |
|---|---|---|---|
| 3,040,488 | 6/1962 | Winkler et al. | 53/542 X |
| 3,562,775 | 2/1971 | Mullins | 53/542 X |
| 3,811,549 | 5/1974 | Preisig | 53/542 X |
| 4,332,124 | 6/1982 | Jaton | 53/542 X |
| 4,398,383 | 8/1983 | Prakken | 53/247 X |
| 4,641,489 | 2/1987 | Wood | 53/542 X |
| 4,707,970 | 11/1987 | Labombarde et al. | 53/529 |

*Primary Examiner*—James F. Coan

*Attorney, Agent, or Firm*—Foley & Lardner, Schwartz, Jeffery, Schwaab, Mack, Blumenthal & Evans

[57] ABSTRACT

In the process of packaging letter envelopes and mailing wallets, the packaging batch is counted in the end region of the production machine, and the individual article of the packaging batch corresponding to the specific batch size is at least identified or optionally pushed a certain distance sideways out of the path of movement of the packaging batch in one direction or the other as a counting article. The packaging batch is deposited on a conveyor belt and conveyed away. A stack support keeps the stack approximately vertical on its end face. The stack support is advanced in front of the stack at the conveying speed of the conveyor belt. As soon as the counting article at the end of a stack has arrived at a transfer point which is at a relatively long distance from the production machine, a separating device is introduced into the stack, with the result that the following portion of the packaging batch is temporarily halted. During this time, the separated stack is pushed, at the same height, into an open container via a slide track. Subsequently, the stack support is guided back to the separation point, and the separating device is retracted from the end face of the following packaging batch, after which the stack support once again takes over the vertical guidance of the packaging batch, until the next counting article has arrived at the separation point. The automatic packaging machine for letter envelopes and mailing wallets has several devices, by means of which the individual steps of the process are executed partly alone and partly in combination with one another.

41 Claims, 21 Drawing Sheets

PROCESS FOR AUTOMATICALLY PACKAGING LETTER ENVELOPES AND MAILING WALLETS INTO A CONTAINER AND AUTOMATIC PACKAGING MACHINE FOR CARRYING OUT THE PROCESS

BACKGROUND OF THE INVENTION

Machines for producing letter envelopes, mailing wallets and similar products from paper and/or plastic webs operate continuously over several hours during a work shift. At the output end of the production machine, the products are counted and packaged into containers, especially into cartons, and the filled containers are either individually conveyed further or stacked on pallets. This packaging is still carried out by hand on many production machines. Because of continuous operation, two persons are usually required as packers at the reception point, so that they can substitute for one another as required. While one of these two persons works at the packaging table, the other person can, if need be, perform auxiliary services.

There exists an automatic packaging machine for the mechanical packaging of letter envelopes or mailing wallets. This is set up at the end of the respective production machine, immediately after the fan disks of the production machine. In this automatic packaging machine, the articles for packaging, in the form of letter envelopes or mailing wallets, are delivered by the fan disks, via a baffle plate, to two delivery belts which are arranged parallel to one another. The delivery belts are each guided round a belt pulley on two parallel shafts, of which one shaft is driven. A stack support is arranged above the plane of the delivery belts and is guided movably in the longitudinal direction of the delivery belts by means of a longitudinal guide. The individual articles of the packaging batch are laid down against the stack support by the fan disks of the production machine. This stack support is moved away from the fan disks, together with the packaging batch, by means of a drive.

In the region of the fan disks, there is a separating device or parting device, by means of which a stack comprising a specific number of individual articles of the packaging batch can be separated from the following packaging batch, while at the same time a gap is formed between the stack and the following packaging batch. This separating device has a separating fork which, in the region of the fan disks, rises from below the resting plane of the delivery belts into the gap between two individual articles still located in the slots of the fan disk and which thereby makes separation possible. This separating fork is guided parallel to itself by means of a parallel crank mechanism and is moved on a circular path, with the result that, over a short distance, it moves together with the packaging batch.

Because the separating fork is arranged in the region of the fan disks, so that it can engage into the interspace between two individual articles of the packaging batch which are still kept separate from one another in the slots of the fan disk, and because, owing to its circular path of movement, it can travel only a limited distance together with the individual articles, only a relatively small number of individual articles can be picked up between it and the fan disks. Thus, the stack separated by the separating fork has to be brought out of the path of movement of the following packaging batch as quickly as possible, to ensure that the stack support can thereupon be brought once again into its supporting position in front of the end face of the following packaging batch. This is necessary so that it can take over the job of supporting the packaging batch well before the separating fork has withdrawn too far. To move away the stack, there is a transfer arrangement which is arranged above the delivery belts. It grasps the stack separated from the following packaging batch and brings it into a transfer position, where the stack is pushed out downwardly into an opened carton.

The transfer arrangement has two transport forks which are arranged on a slide in succession in the direction of the conveying movement of the packaging batch. One transport fork is arranged rigidly on the end of the slide in the direction of movement of the packaging batch. The second transport fork is connected to the slide by means of a vertical lifting device. This is guided movably relative to the first transport fork on a horizontal longitudinal guide of the slide and is coupled to a drive. The slide of the transfer arrangement is itself guided on horizontal longitudinal guides so as to be moveable from the take-over point to the transfer point. It is moved to and from between the takeover point and the transfer point by means of a chain drive.

The stack is grasped by the transfer arrangement according to a procedure in which the stack support, after reaching the rigid transport fork, is retracted laterally out of the path of movement of the stack, with the result that the stack comes up against the rigid transport fork. The stack support is moved back into its initial position in the vicinity of the fan disks. The moveable transport fork is lowered into the gap between the stack and the packaging batch by means of the lifting device and is moved toward the rigid transport fork a certain amount by means of the horizontal drive. The stack located between the two transport forks is thereby compressed and clamped between the transport forks. In this state, the stack is conveyed by the transfer arrangement toward the filling station.

The stack support is once again pushed transversely into the path of movement of the following stacking batch by being inserted into the larger gap produced when the stack is compressed between the moveable transport fork and the separating fork.

In the filling station, the stack held by the transport forks partially rests on bottom plates which are shorter than the stack length. These bottom plates can each be slung down about a pivot axis aligned horizontally and at the same time transversely relative to the path of movement of the stack, from the horizontal position into a position directed vertically downwardly. As a container, a carton with an opened flap is generally raised from below into the filling station. The bottom plates are then swung downwardly into the carton, so that they can serve as guides for the stack. The stack, still held constantly by the transport forks, is pressed out of the transport forks downwardly into the carton by a vertically guided and driven rake. The transfer arrangement with the two transport forks then moves back to the take-over position again. The moveable transport fork is previously raised, so that it can be guided over and beyond the newly formed stack. As soon as the gap is formed at the end of the next stack, the moveable transport fork is lowered into this gap, and this is followed by the next work cycle.

In this transfer arrangement, it is very difficult to change over to other formats. This is also true of a change-over when the paper thickness is changed and- /or when the number of articles in a stack is changed. The separating fork in the region of the fan disks has a stroke of only finite length, and because of this it can also only enter a stack from below up to a specific height. If the stack is of greater height, it can happen that the top edges of the last individual articles of the stack and of the first individual articles of the following packaging batch tip over into the gap, thus impeding, if not even preventing the lowering of the moveable transport fork. This transfer arrangement is therefore suitable only for letter envelopes or mailing wallets of limited height. Moreover, if the height of the stack is changed, the stroke of the pushing-in rake and the stroke of the carton-lifting device must be altered.

Furthermore, whenever the format width is changed, at least the two outer fork prongs of both transport forks have to be set exactly to the new format width. The standing position of the carton must be set to the format width. Whenever the stack length is changed, both the forward movement and the reverse movement of the stack support must be adjusted accordingly. Furthermore, the distance of the two transport forks from one another and in relation to the degree of compression has to be adjusted, the latter depending not only on the stack length but also on the paper thickness, the paper quality and the make-up of the letter envelopes or mailing wallets. Moreover, the carton also has to be set to the changed stack length, inasmuch as the travel of the transport forks remains the same, specifically in relation to the moveable transport forks.

Insofar as the pivot axis of the bottom plates in the filling station is aligned parallel to the direction of movement of the stack, if there is a relatively large variation in the stack length the bottom plates have to be exchanged, because they cannot, of themselves, be either lengthened or shortened. The same applies in a similar way to a variation in the format width, insofar as the pivot axes of the bottom plates are aligned transversely relative to the direction of movement of the stack. Either several groups of bottom plates must be provided for this, or the variation in format is sharply restricted.

In view of the numerous adjusting operations which are necessary, such an automatic packaging machine is very cumbersome where the change-over to other formats is concerned. It can therefore be used to only a limited extent, especially when the batch sizes are relatively small.

A serious disadvantage of this automatic packaging machine is also that the stack is clamped in the filling station between the two transport forks as a free carrier, specifically at the latest from the moment when the bottom plates were swung away downwardly. In such a stack, those surface regions which, because of the larger number of paper layers resting on top of one another, can most easily absorb the compressive forces of the two transport forks in the stack, are distributed in a widely varying manner over the end face of the stack. Consequently, the phenomena of the buckling column with an off-center load or, expressed in the opposite way, with a central load and a cross-section with off-center load bearing occur here. In most cases, that surface region of the stack which transmits the compressive force of the transport forks is at the bottom, and the upper surface regions cannot contribute to supporting the internal bending moment because of the smaller number of their paper layers. Such a carrier clamped only at the two ends all too easily breaks in the middle under its own weight. It can therefore happen that, at the moment when the bottom flaps have been swung downwardly into the carton, the carrier comprising the individual articles sags downwardly in the middle and, after only slight sagging, suddenly breaks open downwardly, specifically even before it has been possible for the lateral edges of the stack to be pushed downwardly by the rake. At best, such a stack which has broken open can be re-arranged by laborious manual work and forced into the carton, by equally laborious manual work. Even when only one fault of this kind occurs, the entire production machine has to be stopped until the damage is rectified. Such an automatic packaging machine therefore puts the smooth operation of the production machine at great risk. Such faults are all the more to be expected because the paper quality of the letter envelopes or mailing wallets, especially as regards the stiffness of the paper as such, the stiffness of the folding point and the flexibility of the paper over its surface and particularly at the folding edges, can vary very widely. There are also great differences as regards the surface roughness on the outer face of the letter envelopes or mailing wallets.

SUMMARY OF THE INVENTION

It is therefore an object of the present invention to provide a process, by means of which a packaging batch in the form of letter envelopes, mailing wallets or the like can be packaged automatically into containers with a higher operating reliability than in the known process.

It is also an object of the invention to provide an automatic packaging machine suitable for carrying out the process.

In accomplishing the foregoing objects, there has been provided according to one aspect of the present invention a process for packaging into a container envelope-like articles which exit serially from a production machine, comprising the steps of serially collecting a packaging batch comprising a plurality of envelope-like articles; counting the envelope-like articles to identify periodically an individual article of the packaging batch which corresponds to a specific batch size of a stack to be packaged, this individual article constituting a counting article; conveying the packaging batch at least semi-continuously in a conveying direction in relation to the further individual articles which are supplied to the packaging batch; moving a supporting part in the conveying direction in front of the head of the packaging batch at a speed equal to supply of the further individual articles to the packaging batch, to thereby keep the batch at least approximately vertical; when the counting article arrives at a separation point located at a predetermined distance in the conveying direction, inserting a separating part transversely relative to the conveying direction of the batch between adjacent envelope-like articles at least in the vicinity of the counting article, to define said stack and temporarily stop a portion of the packaging batch upstream of the stack; after the separating part has been inserted between the stack and the upstream portion of the packaging batch, moving the supporting part a predetermined distance in a direction opposite to the conveying direction to thereby compress the stack to a stack length which is less than the horizontally measured width of the container; filling the compressed stack into the container in a direction transverse to the conveying direction; and after the stack has been transferred into the container, moving the supporting part to the separation point and retracting the separating part out of the path of movement of the upstream portion of the packaging batch.

In one preferred variant the counting step further comprises moving the counting article a predetermined distance laterally with respect to the conveying direction so that it protrudes. In this case the inserting step comprises first engaging and halting the protruding counting article at one edge with the separating part, whereupon a gap is formed downstream of the counting article, and thereafter inserting the separating part into the gap.

According to another preferred variant, the counting step further comprises moving at least the counting article a predetermined distance laterally with respect to the conveying direction to produce a primary gap on the side of the packaging batch facing the separating part. In this case the inserting step comprises first inserting the separating part into the primary gap to engage and halt at the edge the envelope-like articles upstream of the primary gap, whereupon a secondary gap is formed downstream of the separating part, and thereafter inserting the separating part into the secondary gap.

According to still another variant, the inserting step further comprises moving a separating point of the separating part against the edge of the packaging batch in the vincinity of the counting article, eccentrically rotating the tip of the point to produce a gap between adjacent envelope-like articles, and thereafter inserting the separating part into the gap.

According to a further aspect of the present invention there has been provided a machine for packaging into a container envelope-like articles which exit serially from a production machine, comprising means for serially collecting a packaging batch comprising a plurality of envelope-like articles; means for counting the envelope-like articles to identify periodically an individual article of the packaging batch which corresponds to a specific batch size of a stack to be packaged, this individual article constituting a counting article; means for conveying the packaging batch at least semi-continuously in a conveying direction in relation to the further individual articles which are supplied to the packaging batch; a supporting part positioned above the conveying means, for keeping the packaging batch at least approximately vertical; means for moving the supporting part in the conveying direction in front of the head of the packaging batch at a speed equal to supply of the further individual articles to the packaging batch; means for inserting the separating part transversely relative to the conveying direction of the batch between adjacent envelope-like articles at least in the vicinity of the counting article, when the counting article arrives at a separation point located at a predetermined distance in the conveying direction, to define the stack and temporarily stop a portion of the packaging batch upstream of the stack; means for moving the supporting part a predetermined distance in a direction opposite to the conveying direction, after the separating part has been inserted between the stack and the upstream portion of the packaging batch, to thereby compress the stack to a stack length which is less than the horizontally measured width of the container; and means for filling the compressed stack into the container in a direction transverse to the conveying direction.

In one preferred embodiment, the counting means further comprises means for moving the counting article a predetermined distance laterally with respect to the conveying direction so that it protrudes, and in this case the inserting means comprises means for first engaging and halting the protruding counting article at one edge with the separating part, whereupon a gap is formed downstream of the counting article, and means for thereafter inserting the separating part into the gap.

According to another embodiment, the counting means further comprises means for moving at least the counting article a predetermined distance laterally with respect to the conveying direction to produce a primary gap on the side of the packaging batch facing the separating part, and in this case the inserting means comprises means for first inserting the separating part into the primary gap to engage and halt at one edge the envelope-like articles upstream of the primary gap, whereupon a secondary gap is formed downstream of the separating part, and means for thereafter inserting the separating part into the secondary gap.

According to still another embodiment, the inserting means further comprises the separating part having a separating point, means for moving the separating point against the edge of the packaging batch in the vicinity of the counting article, means for eccentrically rotating the tip of the point to produce a gap between adjacent envelope-like articles, and means for thereafter inserting the separating part into the gap.

Further objects, features and advantages of the invention will become apparent from the detailed description of preferred embodiments that follows, when considered together with the attached figures of drawing.

DETAILED DESCRIPTION OF PREFERRED EMBODIMENTS

Figure 1:
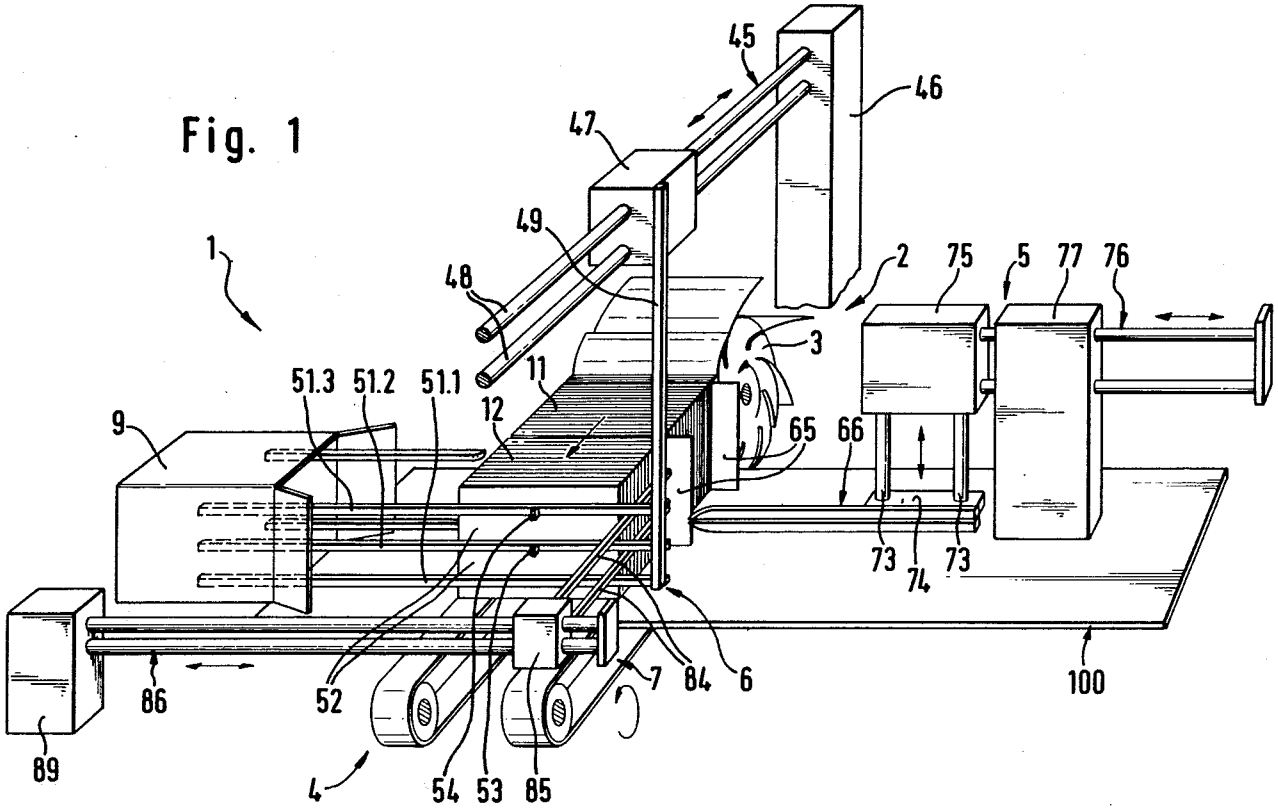
FIG. 1 is a diagrammatic perspective view of the first exemplary embodiment of the automatic packaging machine with a separating sword.

Because, in the first embodiment, the packaging batch is first conveyed away from the production machine a certain distance by means of the delivery belts and the stack to be packaged is separated from the following packaging batch only at some distance from the fan disks of the production machine, a relatively large buildup space with a correspondingly large number of individual items of the packaging batch is obtained between the separation point and the fan disks. This long length portion of the packaging batch conveyed relatively loosely up to the separation point has such a high upsetting capacity that sufficient time remains for the separated stack to be pushed, after the separation point, into the container transversely relative to its original direction of movement. Also, the devices participating in this operation have time to return to their initial position again in order to take over the next stack, and the separation point does not have to move along together with the packaging batch, as occurs in the known packaging machine. Because the packaging batch conveyed up to the separation point has sufficient upsetting capacity, there even remains enough time to compress the separated stack having the original loose packing density and consequently shorten it to a dimension allowing it to be pushed into the container without difficulty. Because the individual article corresponding to a specific batch size of the stack to be packaged and acting as a counting article is pushed sideways a certain distance out of the path of movement when the packaging batch comes out of the production machine, it is possible to halt this counting article and the individual articles following it temporarily on this side. Those surface regions of these individual articles adjacent to this lateral edge region are pushed further somewhat by the following packaging batch, so that the advancing individual articles move away from the halted individual articles in the edge region, thereby forming a sufficiently large gap, into which a separating part can be pushed. At the same time, the entire following packaging batch can be stopped, with its upsetting capacity being utilized, until the separated stack is transferred into the container and the devices participating in this have returned to their initial position again. Because the separated stack is shifted horizontally into the container on a slide track, it does not have to be clamped, lifted and transported in a freely suspended condition. As a result, the unavoidable irregularities in the stack no longer have an adverse effect on the operating cycle of the automatic packaging machine and therefore indirectly also on that of the production machine. The stacks are always separated from the following packaging batch at the same point, namely, the separation point, and from this point are shifted transversely with respect to their original conveying movement. At the same time, both the separating device and the slide track are always in the same location. Because of these factors, any change of format requires only that the stack support be moved in its normal direction of movement away from the separation point to a greater or lesser extent to transfer the stack over a greater or lesser distance. For all formats, the container can be aligned with the invariable plane of the slide track and of the separating device.

In the process according to the second embodiment the same or at least similar conditions apply. The gap for pushing in the separating part is simply formed when the separating part, in a first step of its movement, initially moves into the gap which was formed when the counting piece was partially pushed out onto the other side. At the same time, the individual articles of the packaging batch which are adjacent to the primary gap are temporarily halted again, until there has formed between them and the preceding stack a sufficiently large secondary gap into which the separating part can be pushed completely, in order to separate the stack completely from the following packaging batch.

In the processes according to the third embodiment, the stack is separated from the following packaging batch without a physically detectable counting article being present. By means of an eccentrically rotating tip at the separation point, the separating part separates the visually undetectable counting article, which is present only in numerical terms, from the adjacent individual article by a procedure in which one of these two individual articles, when it comes up against the rotating tip, jumps off from this tip elastically, thereby giving the tip the opportunity to penetrate between these two individual articles. As a result of further rotation and further penetration, the tip finally separates the stack over its entire width from the following packaging batch. The separated stack is thereafter transferred in the same way as in the other processes, here too the upsetting capacity of the packaging batch being utilized for the time sequence of these operations.

As a result of a particular embodiment of these processes, individual articles of the stack are vibrated and at the same time are aligned flush with one another because one of their side edges rests against the transfer part. The individual articles therefore no longer have to be realigned in the container, in order to be able to close the container and also in order to ensure that the stack has a pleasing appearance in the container. If this process step is developed in accordance with claim 5, it becomes even easier to align the individual articles in the stack because the bearing force of the individual articles against one another is then lower. An embodiment of the process as claimed in claim 6, ensures that the stack is guided right into the interior of the container, thus preventing virtually completely the danger of skewing or brushing against the container walls. Because the stack is shifted beyond the container depth, as a result of which the container is pushed away by the stack itself, this guarantees that all the individual articles of the stack are pushed into the container right to its very bottom. This prevents the possibility that the individual articles which, if the stack is pushed in only partially, rest against the container walls on the two end faces of the stack will be held back somewhat by the container walls as a result of frictional connection and would subsequently have to be pushed in flush with the remaining individual articles.

In the automatic packaging machine according to the invention, the delivery belts are driven continuously and not intermittently, and the drive is also synchronized with the actual feed speed of the individual articles. Interruptions on the production machine are also taken into account. Consequently, there is no compacting or thinning-out in the packaging batch. Because the stack support is guided on its own guide and it has its own drive, in this region of the automatic packaging machine, it is possible to change over to other formats without difficulty as regards the dimensions of the individual articles, the type of folding and the material qualities. Since the stack support has two or more horizontally aligned strip-shaped supporting elements above one another, an at least approximately vertical guidance of the packaging batch over its entire height becomes possible. An interspace open in the pushing-out direction of the packaging batch is present between two supporting elements adjacent to one another, and as a result other elements of the transfer arrangement can reach through the interspaces and push out the parts of the packaging batch completely to the side, without having to clamp this part of the packaging batch.

Because the separating device is arranged at a certain distance from the fan disks of the production machine, a sufficiently large build-up space is available, with the packaging batch located in it having such a high upsetting capacity that enough time remains for separating the stack, transferring it into the container and returning all the participating devices into their initial positions.

The separating device has a separating sword with a wedge-shaped head and with a shank which adjoins this, and the total length is at least equal to the maximum possible width of the packaging batch. Furthermore, the separating sword is guided on a guide transversely relative to the path of movement of the packaging batch and is coupled to a drive. It can therefore separate the stack to be packaged from the following packaging batch over its entire width and over the full height. The separating sword is arranged in its rest position so that the tip of its head projects at least partially into the path of movement of the counting piece, and there is, in this region of the tip of the separating sword, at least one sensor which transmits a control signal when the counting piece approaches and/or comes up against the tip. A delay element is furthermore inserted in the control of the drive. With this arrangement it is possible to detect the arrival of the counting piece at the separation point, temporarily halt the counting piece and the immediately following individual articles as a result of a delayed cut-in of the drive of the separating sword, while the remaining individual articles are pushed further by the following packaging batch, and in this way form between the counting piece and the advancing individual articles a relatively large gap. The separating sword can subsequently be pushed into this gap with its wedge-shaped head and then further with its entire shank, until the stack is separated completely from the following packaging batch.

Because the transfer arrangement is designed as a shifting arrangement having a shifting rake, the prongs of which extend above or below the horizontal supporting elements of the stack support through at least up to the separating sword, and because the shifting rake is guided shiftably transversely relative to the path of movement of the packaging batch by means of a longitudinal guide and is coupled to a drive, the separated stack can be shifted laterally into the container at a constant height, without the stack having to be grasped and clamped by a grab device and/or transported in a freely suspended condition. As a result of this horizontal sliding shift of the stack on a fixed slide track through between guide elements located on both sides, the stack can be pushed into the container without any difficulty. At the same time, for example, neither a differing distribution of the number of paper layers, nor different properties of the material of the individual articles can give rise to faults in the operating cycle. Nor can the stack break open, as can occur in the known automatic packaging machine.

In a second embodiment of the automatic packaging machine according to the invention, substantially identical and otherwise very similar conditions prevail. The only difference is that the sensor at the tip of the separating sword responds not to contact with a counting piece pushed out of the packaging batch, but to the gap caused by the counting piece pushed out to the other side, thus transmitting a control signal. Furthermore, the insertion movement of the separating sword takes place in two steps. In the first step of its insertion movement it only moves into the primary gap formed when the counting article is pushed out, and thereby temporarily halts the following individual articles, and only after the formation of a sufficiently large secondary gap between the counting article and the following individual articles does it move into these and through the packaging batch.

In the automatic packaging machine according to the third embodiment of the invention, once again most of the devices are identical or substantially similar to those of the automatic packaging machine of the first embodiment. In the automatic packaging machine of the third embodiment, only the separating device is modified to any great extent, since it has no counting articles which are pushed out a certain distance to one side or the other and which can therefore be detected visually. In it, the counting article is merely an individual article detected numerically, at which the separating operation is carried out. Because this separating device has an eccentrically rotating conical tip which is moved up against the packaging batch when the counting article arrives at the separation point, it can happen that either it encounters a gap between the counting article and one of the adjacent individual articles or it touches and slightly upsets elastically the counting article or the individual article adjacent to it on one side or the other. In the latter case, as a result of the continuous eccentric rotary movement and the further penetration of the conical tip, and as a result of the further travel of the packaging batch transversely relative to the direction of approach of the conical tip, that individual article which the conical tip came up against first will jump off from the conical tip. Consequently, the conical tip is already between this individual article and the adjacent individual article, and as a result of further penetration and simultaneous eccentric rotary movement it constantly enlarges the gap, into which the entire separating lance is then introduced. The further cycles are the same as those in the other two automatic packaging machines.

In an embodiment of the automatic packaging machines, in which the delivery belts extend, counter to the conveying direction of the packaging batch, right into the region of horizontal projection of the fan disks of the production machine, the individual articles of the packaging batch which are supplied are deposited directly on the delivery belts by the fan disks. The particular individual article deposited does not yet rest against the preceding individual article and therefore cannot prevent it, as a result of frictional connection, from resting completely on the delivery belts. The individual articles of the packaging batch can therefore be aligned flush with one another in terms of height from the very outset. In another embodiment of the automatic packaging machines, the stack support, together with its longitudinal guide, the separating device and the transfer arrangement can be detached from the table stand with the delivery belts and transferred from one production machine to another production machine which likewise has a table stand with delivery belts of identical or similar type.

In an embodiment of the automatic packaging machines including a sensor, especially when the stack support is equipped with two sensors at different heights, it is possible to ascertain whether the packaging batch is so near to the stack support that it rests equally against the stack support both at the bottom and at the top or whether the foremost individual article is still at a certain distance from the stack support at the top or bottom, because, particularly depending on the position of the surface regions with the largest number of paper layers, it is tilted with the top edge forward or conversely with the bottom edge forward, the respective other edge being set back a certain distance. As a result, the speed of movement of the stack support can be adjusted so that even the foremost individual article of the packaging batch is aligned vertically and therefore parallel to the remaining individual articles of the packaging batch. The packaging batch is consequently conveyed substantially uniformly. In another embodiment of the automatic packaging machine, a rotatably mounted wheel resting on one of the delivery belts ensures that, in the event of a relative movement of the delivery belts underneath the friction wheel, the friction wheel is rotated relative to its bearing axis. The friction wheel is connected to a control disk in the form of a cam disk interacting with a touch-contact switch which converts a rotary movement of the control disk into corresponding control signals, and in this manner a further possibility of control is obtained. As a result of this, the stack support is moved further with the further conveyed packaging batch albeit at small intervals, but uniformly overall. At the same time, during the movement of the stack support, temporary reductions in the conveying speed of the delivery belts are also taken into account, these reductions possibly occurring as a result of temporary interruptions in the supply of individual articles of the packaging batch from the production machine when, because of minor faults in the latter, individual or a few workpieces have to be taken out of continuous production, or when the manufacture of letter envelopes or mailing wallets in the production machine is temporarily interrupted despite the fact that the machine continues to run. This is very important because the uniformity of the stack to be separated and the uniform vertical alignment of its individual articles are thereby largely preserved, even in the event of temporary faults in the production machine. This is beneficial to perfect separation of the stack from the following packaging batch. Furthermore, this prevents the stack support from being moved further purely as a result of accidental contact of the first individual article against the two sensors of the stack support.

In still another embodiment of the automatic packaging machines, the longitudinal grooves on the side of the separating sword face the stack support and ensure that the prongs of the transfer rake can reach right into these longitudinal grooves of the separating sword, so that even the rear individual article of the separated stack is grasped by the prongs of the shifting rake. As a result, despite the friction on the separating sword, it cannot remain behind, but is shifted into the container reliably together with the remaining individual articles of the stack.

In another embodiment, the separating sword is initially guided, in the form of a compact separating body with a small vertical dimension, along the lower edge of the packaging batch into the gap and through it. The alignment of the individual articles above the gap is of virtually no importance, that is to say, even a slight inclination of the individual articles can be accepted. Only after the separating sword has been introduced completely is the upper moveable part of the separating sword raised into its operating position, and the individual articles which are possibly not exactly vertical are aligned vertically on both sides of the gap, so that the rear individual article of the stack in particular has the vertical alignment necessary for satisfactory insertion into the container. It is thereby possible to separate the stack perfectly from the following packaging batch even under unfavorable conditions, for example, when the stack is very long and because of this the supporting and aligning effect of the stack support is no longer exerted right up to the rear end of the stack, and/or when the stack batch is very high and, for example, there is also a great difference in the packing density between the top and bottom edges of the stack batch. Another feature of the automatic packaging machine ensures, even when the separating sword is in two parts, that the prongs of the shifting fork grasp the rear individual article of the stack perfectly on both parts of the separating sword, because the prongs reach into the longitudinal grooves.

In still another embodiment of the automatic packaging machine the guide elements of the stack support and the separating sword or separating lance can have dimensions which are little larger than the maximum possible width of the stack. The further guide elements in alignment with the guide elements of the stack support and of the separating sword or separating lance bridge the interspace approximately up to the bottom of the container. At least one group of the further guide elements is mounted pivotably about a common pivot axis aligned vertically and it is under the effect of a spring member, by means of which they can be pivoted slightly toward the interior of the container. Consequently, the container can be pushed onto these further guide elements from outside more easily. When the stack is pushed in, they are pivoted outwardly by the latter up against the wall of the container, counter to the effect of the spring member, so that the stack can be pushed completely and unimpeded into the container.

As a result of a further embodiment of the automatic packaging machines, the stack is vibrated at the start of its transfer movement, thus markedly reducing the frictional connection between the individual articles resting against one another. At the same time, the shifting rake set in motion at the same time in the direction of the container, ensures, by means of its prongs, that the respective edges of the individual articles of the stack which rest against it are aligned flush with one another. This specifically includes the counting article which originally projected noticeably on the other side. As a result, the individual articles of the stack also have a pleasing alignment flush with one another in the container.

One preferred automatic packaging machine is designed with a separating lance and avoids a rotary mounting by fastening the shank of the separating lance directly to a slide or carriage, by means of which the separating lance is guided shiftably or movably on the longitudinal guide. The projecting separating lance thereby acquires greater rigidity. Moreover, it is therefore no longer necessary to select a circular cross-sectional form for the shank. On the contrary, it can be designed with other factors in mind, for example, the cross-sectional form can be chosen greater in height than in width, the shank of the separating lance having more the form of a sword or the form of a lance. Because the conical head is mounted rotatably on the shank or preferably in the longitudinal through-hole in the shank, the drive shaft merely has to transmit the very low torque for the rotary movement of the conical head. It could therefore be made relatively thin, so that it takes up only little space on or in the shank. As a result of a further development of the automatic packaging machine which also used the separating lance, a prong of the shifting rake can reach into the groove of the shank, so that, here again, the last individual article of the stack is grasped securely during the shifting action.

An automatic packaging machine designed according to claim 34 makes it possible for the stack to be separated from the following packaging batch, even under unfavorable circumstances, in the same perfect way as is possible in the automatic packaging machines having a separating sword.

According to another embodiment, it becomes easier for the automatic packaging machine to be started or put into operation together with the activation of the production machine, because the starting support supports the start of the packaging batch and keeps it in vertical alignment even before the start of the packaging batch has reached the separation point, from which it is taken over and supported by the stack support. The temporary use of the starting support is expedient not only when the production machine is changed over to a new format of the packaging batch and therefore has been restarted, but also when, as a result of production faults in the production machine or during routine interruptions in operation, the production machine is restarted and there is no longer a sufficient number of individual articles between the fan disks and the stack support remaining from the preceding operating period, or when a relatively large number of individual articles have been taken out of the packaging batch for whatever reason.

The invention is explained in detail below with reference to several exemplary embodiments of automatic packaging machines shown in the drawings.

The automatic packaging machine 1, the essential parts of which can be seen in FIG. 1, is set up to follow a production machine 2 for letter envelopes, mailing wallets or the like. Of this production machine 2, only the fan disks 3 are shown. By means of the fan disks 3, the individual letter envelopes or mailing wallets supplied lying flat in succession by the transport elements of the production machine 2 are erected and lined up in succession end face to end face. This operation can be seen in detail in FIG. 3. Instead of the fan disks 3, other devices, for example suction cylinders, can also be provided, in order to erect and line up the individual articles. The following explanations apply equally to these.

The automatic packaging machine 1 has, as main sub-assemblies, a delivery table 4, a separating device 5, a stack support 6 and a transfer arrangement 7. As a further sub-assembly there is also a handling arrangement 8 for containers 9, which will be explained in detail later with reference to FIGS. 26 to 34.

The individual articles 10 (FIG. 3) comprising the letter envelopes, mailing wallets or similar products produced from paper webs and/or plastic webs on the production machine are lined up in succession on the delivery table 4 by the fan disks 3. Of this relatively long row of successive individual articles, which is referred to below as a packaging batch 11, a specific number of individual articles are separated as a stack 12 by the separating device 5 and are pushed into a container 9 by the transfer arrangement 6.

Figure 2:
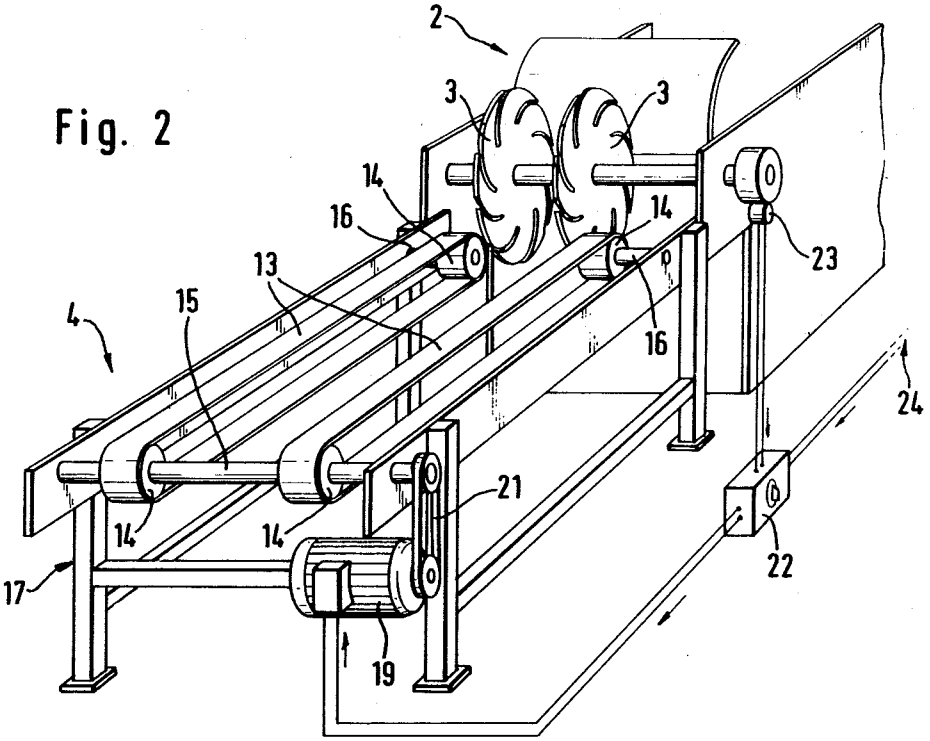
FIG. 2 is a perspective view of a delivery table with delivery belts.
Figure 3:
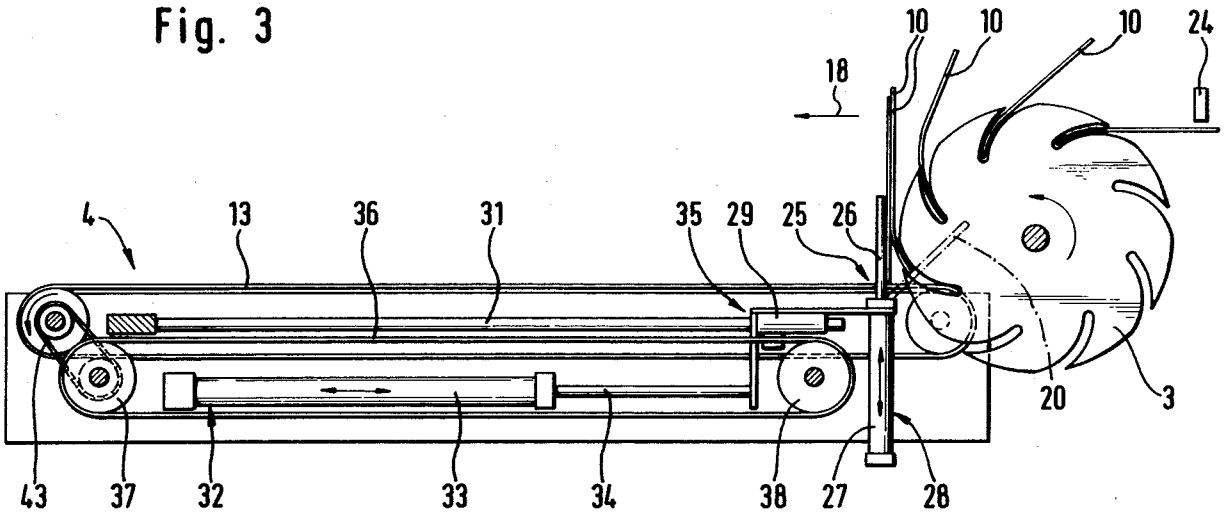
FIG. 3 is a side view of the delivery table at the beginning of the starting phase.
Figure 4:
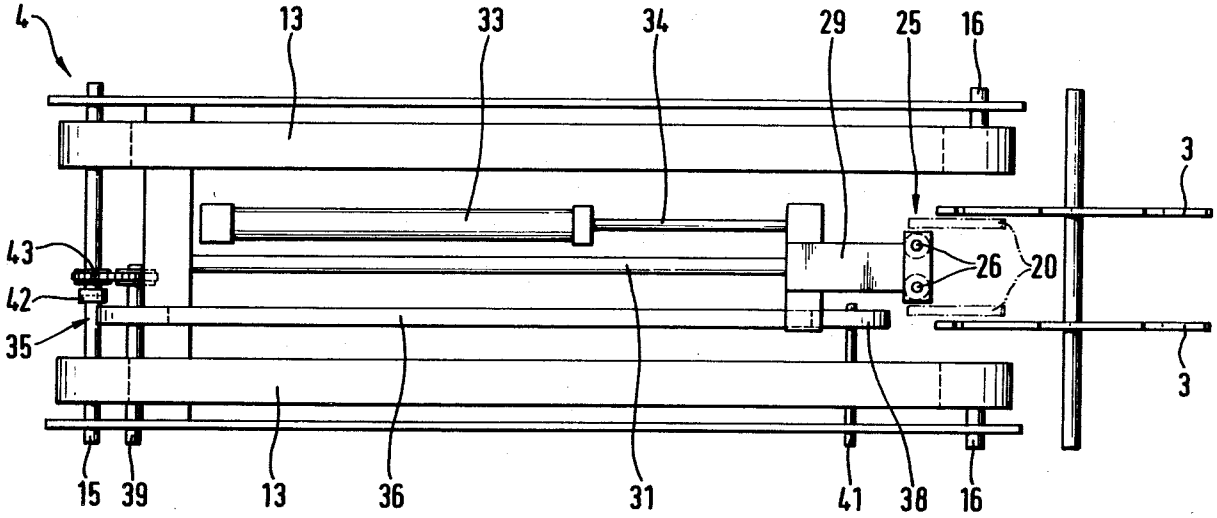
FIG. 4 is a plan view of the delivery table according to FIG. 2.

The delivery table 4 has two delivery belts 13 (FIG. 2) which take the form of flat belts and which are annularly endless. They are arranged next to and at a certain distance from one another. The delivery belts 13 are each wrapped round two belt pulleys 14 which are located in pairs on a respective shaft 15 and 16. The two shafts 15 and 16 are mounted rotatably on a table stand 17. The table stand 17 is arranged to follow the production machine 2, in such a way that the start of the delivery belts 13 extends counter to the conveying direction of the packaging batch 11, represented in FIG. 3 by the arrow 18, into the region of horizontal projection of the fan disks 3, as can be seen from FIGS. 3 and 4. As a result, the individual articles 10 of the packaging batch are deposited directly on the delivery belts 13, as illustrated in FIG. 3. If there is a relatively large height difference between the axis of rotation of the fan disks 3 and the depositing plane of the delivery belts 13, it can be expedient to arrange between the fan disks 3 and the delivery belts 13 a baffle plate or several baffle plates 20 which form a certain angle with the depositing plane of the delivery belts 13, as indicated by dot-and-dash lines in FIG. 3. As a result, the lower edge of the individual articles 10 which is guided by the slots of the fan disks 3 meets the baffle plates 20 at an angle of incidence which is larger than the angle of incidence which occurs when the delivery belts 13 are set lower. A larger angle of incidence up to a right angle is advantageous, above all, for the processing of those individual articles which have only slight rigidity.

The shaft 15 of the delivery belts 13 is driven continuously by means of an electric motor 19 via a V-belt drive 21. The drive speed of the electric motor 19 is controlled by a control device 22 which receives its control signals, on the one hand, from a tachogenerator 23 coupled to the shaft of the fan disks 3, so that these control signals are generated as a function of the production speed or conveying speed of the production machine 2. On the other hand, the control device 22 receives control signals from a sensor 24 arranged in the run-in region of the fan disks 3 (FIG. 3). By means of the control signals from the tachogenerator 23, the drive of the delivery belts 13 can be adjusted as a function of the conveying speed of the production machine 2 which is given by the depositing speed of the fan disks 3. At the same time, different conditions of the packaging batch 11, e.g., determined by the paper thickness, the number of layers resting on top of one another at the folding points and gluing points, the resilience of the material, especially at the folding points, and the like, can be taken into account on the control device 22. The sensor 24 senses the individual articles 10 which are fed to the fan disks 3 from the preceding production stations. In the absence of individual articles 10, it transmits a corresponding control signal to the control device 22, by means of which the drive of the delivery belts 13 is reduced correspondingly. As a result, the delivery belts 13 are always driven as a function of the actual feed speed of the individual articles 10 to the packaging batch 11 and according to the actual space requirement of the latter.

The upper strand or working strand of the delivery belts 13 slides over and beyond the top side of a table plate of the delivery table 4, not shown in FIGS. 2 to 7 for the sake of clarity, in order to prevent the upper strand of the delivery belts 13 from sagging under the weight of the packaging batch As can be seen from FIGS. 3 to 7, in the region of the delivery belts 13 there is a starting support 25. It is embodied by the piston rods 26 of two vertically aligned pneumatic piston drives 27 arranged next to one another. These piston drives 27 form a lifting device 28 for the starting support 25, by means of which the starting support 25 can be lowered into a position of rest, in which it is below the plane of the delivery belts 13 (FIG. 6), and can be raised into an operating position (FIGS. 3 and 5), in which it extends at least high enough to prevent the individual articles located at the start of the packaging batch 11 from falling over and also buckling. Appropriately, the piston rods 26 extend over and beyond the middle of the packaging batch 11 at their greatest height.

The starting support 25 is arranged on a slide 29 which is guided so as to be movable parallel to the delivery belts 13 by means of a longitudinal guide 31. The slide 29 and the longitudinal guide 31 are designed and arranged so that, in one end position (FIGS. 3 and 4), the starting support 25 is in the vicinity of the fan disks 3 and can be shifted in the conveying direction of the packaging batch 11 at least up to the separating device 5 as shown in FIG. 6.

For shifting the starting support 25 into the end position at the fan disks 3, there is a first drive 32 having a single-acting pneumatic piston drive 33, to the piston rod 34 of which the slide 29 is coupled. The starting support 25 is shifted out of this end position ahead of the following packaging batch 11 by means of a second drive 35. This drive 35 has an angularly endless drive belt 36 which is arranged parallel to the delivery belts 13 and which is guided round a respective belt pulley 37 and 38. The belt pulley 37 is located on a shaft 39 which is mounted rotatably on the delivery table 4. The belt pulley 38 is mounted rotatably on an axle 41 fastened to the delivery table 4. The drive belt 36 is coupled non-positively to the shaft 15 via a slipping clutch 42 and a chain mechanism 43. This drive is designed so that the starting support 25 is moved at least approximately at the same conveying speed as the delivery belts 13.

Figure 5:
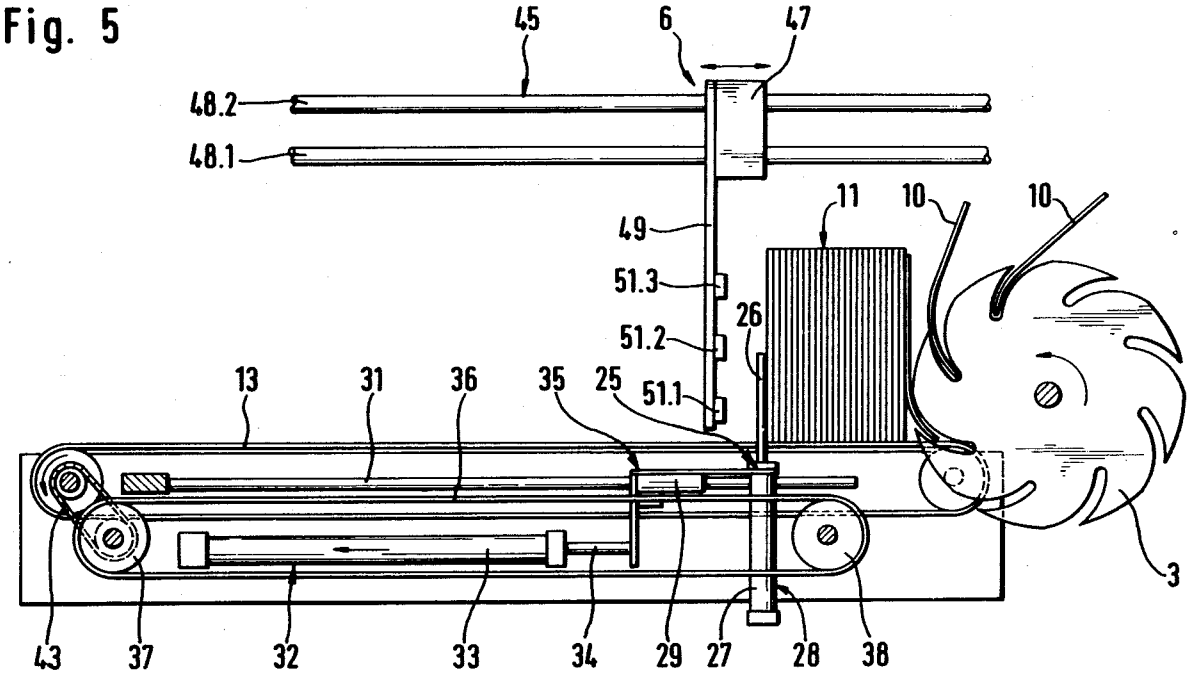
FIG. 5 is a side view of the delivery table, together with a stack support, at a moment in the middle of the starting phase.
Figure 6:
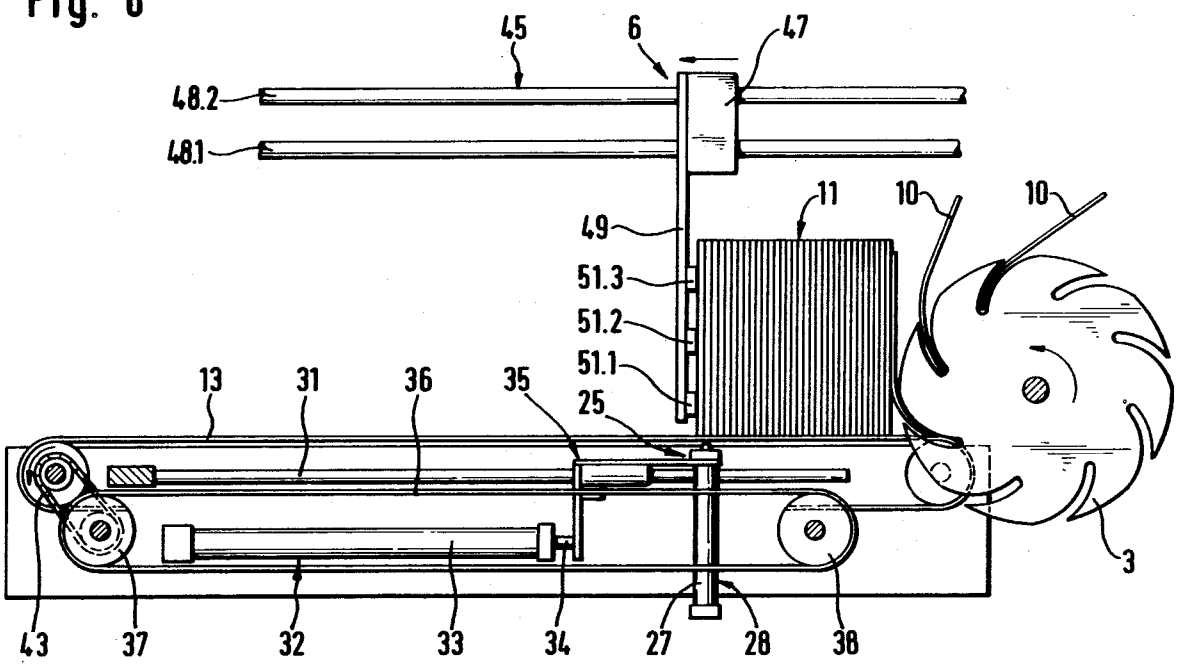
FIG. 6 is a side view of the delivery table at the end of the starting phase.

The function of the starting support 25 is, when the production machine 2 starts up, to keep the individual articles 10 of the packaging batch 11, which are laid down or, more exactly, set down on the delivery belts 13 by the fan disks 3, in the vertical position (FIGS. 3 and 5), until the packaging batch 11 has arrived at the stack support 6 (FIG. 6). Such a starting operation takes place whenever the production machine 2 has been changed over to another format of the packaging batch and is literally restarted, or whenever, after a production fault in the production machine 2 or even in the automatic packaging machine 1, or after a routine interruption in the operation of the production machine 2, the latter is restarted with the packaging batch remaining the same, and when there is not or no longer a sufficient number of individual articles of the packaging batch 11 between the fan disks 3 and the stack support 6 located in the initial position (FIG. 6) to keep the packaging batch vertical because of the production failure or for other reasons. If there is still such a residue of a packaging batch in this sector, it is appropriately taken out or lined up in front of the starting support 25. The starting support 25 is shifted into its end position at the fan disks 3 by means of the drive 32 from the control desk of the automatic packaging machine The starting support 25 is extended upwardly into its operating position by means of the lifting device 28 (FIG. 3). After the production machine 2 has started up, the individual articles 10 are deposited in an increasing number on the delivery belts 13, with the stack support 25 travelling along together with the delivery belts 13 (FIG. 5). As soon as the starting support 25 has reached the stack support 6, the starting support 25 is lowered again into its rest position underneath the delivery belts 13, by means of the lifting device 28 (FIG. 6). From then on, the stack support 6 takes over the guidance of the packaging batch 11.

The stack support 6 has a longitudinal guide 45 which is arranged above the delivery belts 13 and which is held by a stand 46, only part of this being shown in FIG. 1 for the sake of clarity. The stack support 6 has a slide 47 which is guided on the longitudinal guide 45 so as to be movable longitudinally. This longitudinal guide 45 is designed, for example, as a result of using two guide rails or guide rods 48.1 and 48.2 arranged at a certain distance from one another, so that it can absorb torques about the longitudinal axis of the guide 45 which occur as a consequence of eccentric weight forces or actuating forces on the slide 47. The guide rods 48.1 and 48.2 are metal rods of circular cross-section. Sliding bushings or spherical bushing adjusted to these are arranged in the slide 47, depending on how high the sliding speeds are. Sliding bushing are less sensitive to unavoidable paper fluff than spherical bushing.

A carrier 49 extends downwardly from the slide 47 to just above the delivery table 4. Attached firmly to the carrier 49 are three strip-shaped supporting elements or, in brief, supporting strips 51 which are arranged horizontally and which are aligned at right angles to the path of movement of the delivery belts 13. The three supporting strips, designated by 51.1, 51.2 and 51.3 to distinguish them better from one another, extend from the carrier 49, located next to the path of movement of the packaging batch 11 and stack 12 at least over and beyond the maximum width of the packaging batch 11. In FIG. 1, for the sake of simplicity, they are shown so long that they reach into the container 9. In actual fact, they are shorter, as will be explained later.

The supporting strips 51 are arranged above one another at a mutual distance, so that between them there is a respective interspace 52 (FIG. 1) which is open in the pushing-out direction of the stack 12, that is to say in the direction of the container 9. The stack support 6 is moved at least approximately at the same conveying speed as the delivery belts 13. For this purpose, the slide 47 is moved both in the conveying direction of the packaging batch 11 and in the opposite direction by means of a toothed belt not shown in the drawing. This is wrapped round respective toothed-belt pulleys which are each mounted rotatably in one of the columns of the stand 46. One of these toothed-belt pulleys is driven by means of an electric motor, likewise not shown, which, by means of a control, is controlled in the conveying direction of the packaging batch 11 as a function of the conveying speed of the delivery belts 13. The return speed is higher. Instead of the toothed-belt drive, for example, a spindle drive can also be used, especially one with a ballscrew nut.

Figure 8:
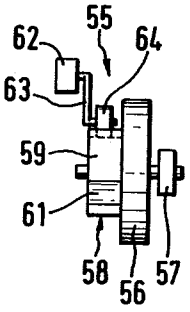
FIG. 8 is an end view of the sensor device according to FIG. 7.
Figure 7:
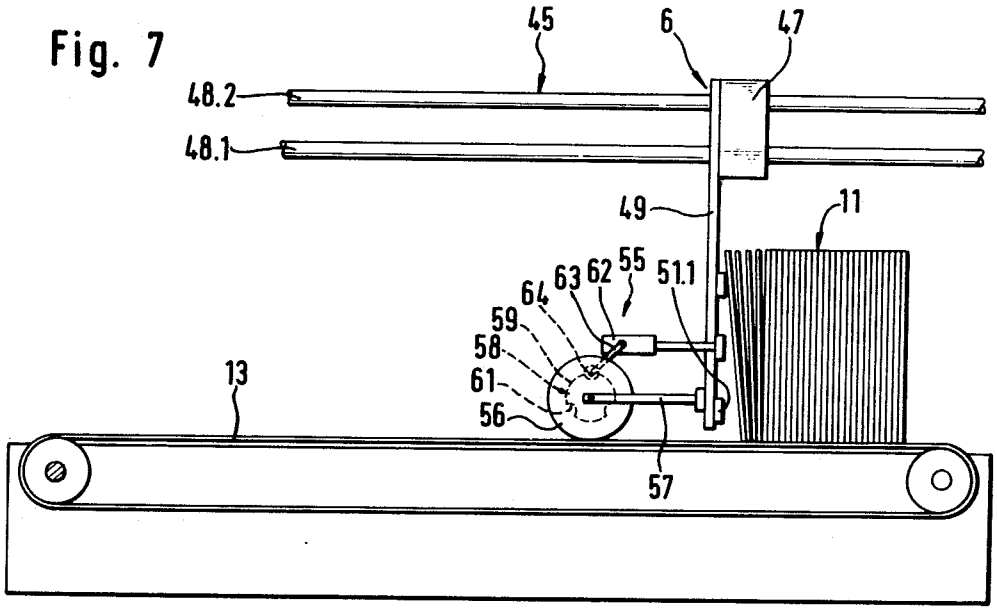
FIG. 7 is a side view of the stack support according to FIG. 5 with a sensor device for its drive control.

The control of the drive of the stack support 6 receives its control signals from two sensors 53 and 54 (FIG. 1) and from a control device 55 (FIGS. 7 and 8).

The sensors 53 and 54 are arranged on the stack support 6, specifically the sensor 53 on the lower supporting strip 51.1 and the sensor 54 on the upper supporting strip 51.3 (FIG. 1). The sensors 53 and 54 are arranged so that they take effect on the side facing the packaging batch. In the simplest case, they extend from the side of the relevant supporting strip facing away from the packaging batch 11 through the supporting strip to the other side. The sensors 53 and 54 are designed so that they generate a control signal when the foremost individual article of the packaging batch 11 approaches and/or comes in contact with the associated supporting strip.

The control device 55 has a friction wheel 56 which is mounted rotatably on a guide 57 in the vertical plane of alignment of one of the two conveyor belts 13. The guide 57 is arranged on the stack support 6, specifically on its lower supporting strip 51.1, in such a way that the friction wheel rests on the delivery belt 13 under its own weight. If required, the guide 57 can also be designed so that an additional spring force is exerted on the friction wheel 56 in the direction of the delivery belt 13. The friction wheel 56 is connected fixedly in terms of rotation to a control disk 58 having, on its peripheral surface, three peripheral regions 59 formed by three segments of a surface of a circular cylinder which are of equal length in the peripheral direction and which have a specific radius in relation to the axis of rotation of the control disk 58. Between them are three peripheral regions 61, of which the radial distance outside the transition point to the peripheral regions 59 is smaller than the radius of the peripheral regions 59. These peripheral regions can be formed, for example, by three portions of the surface of a hollow circular cylinder which are of equal length. These concavely curved peripheral regions 61 have a shorter extension in the peripheral direction than the convexly curved peripheral regions 59. A touch-contact switch 62 interacts with the control disk 58. This touch-contact switch 62 has a pivotable tracer member 63, on the free end of which is mounted rotatably a tracer roller 64, the radius of which is smaller than the radius of curvature of the peripheral regions 61, or vice versa. The touch-contact switch 62 is arranged so that its tracer member, specifically the tracer roller 64, can interact with the control disk 58, so that, when the tracer roller 64 rolls on the convexly curved peripheral regions 59, the touch-contact switch 62 is in one switching position and, when the tracer roller 64 rolls on the concavely curved peripheral regions 61, the touch-contact switch 62 is in the other switching position and thereby transmits corresponding control signals to the control circuit for driving the stack support 6.

In the control circuit for driving the stack support 6, the control signals from the two sensors 53 and 54 and those from the touch-contact switch 62 interact via an AND-operation, in such a way that when all three input signals are present the drive of the stack support 6 is cut in, and when even only one of the three input signals is absent the drive of the stack support 6 is cut out. This control ensures that an actuating signal for driving the stack support 6 is transmitted via the two sensors 53 and 54 only when the packaging batch 11 generates a control signal on both sensors 53 and 54. This presupposes that the packaging batch 11 rests both against the lower supporting strip 51.1 near its bottom edge and against the upper supporting strip 51.3 near its top edge. This state can be seen in FIG. 6, whereas in FIG. 7 it has not yet been reached. In FIG. 7, the packaging batch 11 still has to cover a short distance toward the stack support 6, until the lower sensor 53 on the supporting strip 51.1 also actuates the contact of the packaging batch by a control signal.

A further condition for an actuating signal to drive the stack support 6 is that the touch-contact switch 62 must be cut in. If this is assumed in the position of the control disk 58 and of the tracer member 63 shown in FIG. 7, an actuating signal will nevertheless not yet be generated because the lower sensor 53 does not yet transmit an appropriate control signal. In such a case, the stack support 6 remains at rest, whereas the delivery belts 13 continue to run and move the packaging batch 11 further toward the stack support 6. As a result of this relative movement between the delivery belts 13 and the stack support 6, the friction wheel 56 resting on one of the delivery belts 13 rotates, and after a certain small angle of rotation the tracer toller 64 passes from one peripheral region 61 to the adjacent peripheral region 59 and the touch-contact switch 62 thereby switches over. It then does not transmit any control signal for the time being, until, after a further rolling movement of the friction wheel 56 on the delivery belt 13, the tracer roller 64 arrives at a peripheral region 61 once more and the touch-contact switch 62 is cut in again and transmits a control signal. Then, when the packaging batch 11 has been conveyed further by the delivery belts 13 over such a distance that it now also rests against the lower supporting strip 51.1 and consequently the lower sensor 53 transmits a control signal, an actuating signal for the drive of the stack support 6 is transmitted in the control circuit. The stack support 6 is then moved further a specific distance, the length of which is predetermined by the setting parameters of the control circuit. At all events, the advancing speed of the stack support 6 is selected higher than the average conveying speed of the delivery belts 13. During the advancing movement of the stack support 6, the friction wheel 56 therefore rolls on the delivery belt 13 in the opposite direction of rotation, with the result that, after a specific short period of time, the touch-contact switch 62 is switched over again and the drive of the stack support 6 is cut out once more. This persists until the touch-contact switch 62 is cut in again as a result of the rolling movement of the friction wheel 56 in the original direction of rotation.

Because of this pilgrim-step movement of the friction wheel 56 in relation to the delivery belt 13, the stack support 6 executes an intermittent following movement relative to the delivery belts 13. This intermittent following movement takes effect only on relatively few individual articles at the head of the packaging batch 11, because of the small pilgrim steps and because of the sufficiently high upsetting capacity of the packaging batch 11. It therefore has no adverse effect on the uniform conveyance of the greater part of the packaging batch 11. The great advantage of this method of controlling and actuating the drive of the stack support is that the latter is always moved further according to the actual conveying movement of the packaging batch 11, and that, for example, changes in the upsetting capacity or the elastic stretching of the packaging batch, such as can occur, for instance, during a change of the paper roll at the start of the production machine, are thereby taken into account automatically.

The separating device 5 includes an auxiliary device, not shown in the drawing, which is arranged on the production machine on the run-off side of the fan disks 3. This auxiliary device has a counter and a shifting means controlled by the counter. A sensor of the counter detects, in a similar way to the sensor 24 (FIG. 3), the number of individual articles 10 transferred from the production machine 2 to the automatic packaging machine 1 by the fan disks 3. The shifting means shifts the individual article corresponding to a specific number "n" of individual articles out of the normal path of movement of the individual articles 10 and of the packaging batch 11, i.e., a certain distance toward the side on which the separating device 5 is located. This pushed-out individual article moves along together with the packaging batch as a counting article 65, as can be seen in FIG. 1.

The separating device 5 is arranged at a certain distance from the fan disks 3 of the production machine 2, as is evident from FIG. 1. This distance depends on the upsetting capacity of the packaging batch 11, on the working speed of the production machine 2, on the thickness of the separating element of the separating device 5 and on the working speed of the separating device 5 and of the transfer arrangement 7. This distance is appropriately between 100 mm and 500 mm.

Figure 9:
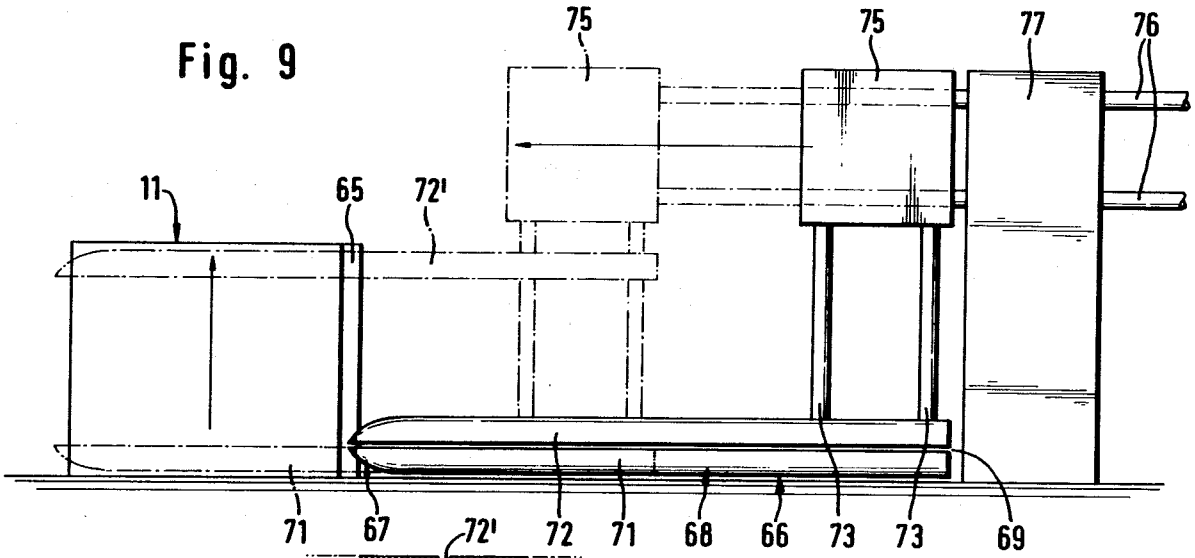
FIG. 9 is a diagrammatic side view of a separating device of the automatic packaging machine with a separating sword.
Figure 13:
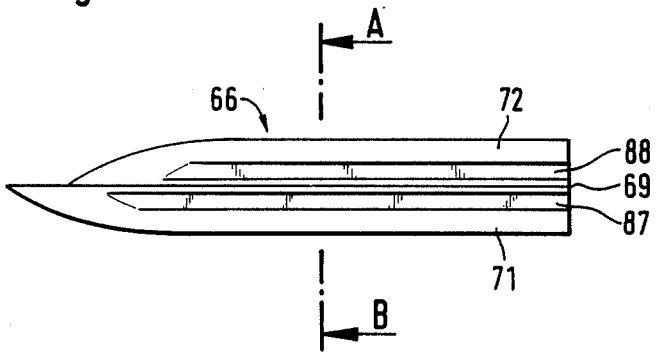
FIG. 13 is a side view of the separating sword.

The separating device 5 has, as a separating element, a separating sword 66 with a wedge-shaped head 67 and with a shank 68 adjoining this. The separating sword 66 is divided over its entire length, along a parting line 69 extending in a horizontal plane, into two parts, specifically the bottom part 71 and the top part 72 (FIGS. 9 and 13). The bottom part 71 is connected firmly to two spacers 73. The top part 72 is connected to a slide 74 (FIG. 1) which is movable vertically on the spacers 73 serving as a longitudinal guide. The spacers 73 are connected to a holding head 75 which is arranged higher than the maximum possible height of the packaging batch 11 above the depositing plane of the delivery belts 13. The holding head 75 is guided movably in the horizontal direction on a pillar 77 by means of a longitudinal guide 76, the shifting direction being aligned at right angles to the path of movement of the packaging batch 11. Sliding bushings for guiding the respective rod parts are provided both on the slide 74 and on the pillar 77. A pneumatic piston drive (not shown) serves respectively for driving them. On the spacers 73 or on the drive, there is a height stop (not shown) which is of adjustable height so that the top part 72 can be moved into positions of differing height.

The free length of the separating sword 66 outside the connection to the spacers 73 is at least equal to, but appropriately somewhat greater than the maximum possible width of the packaging batch 11 to be processed. The holding head 75, the longitudinal guide 76 and the pillar 77 are designed and arranged so that the separating sword 66 can be moved to and from between a rest position, represented by unbroken lines in FIG. 9, and a separating position, represented by dot and dash lines in FIG. 9. In the rest position, the tip of the head 67 of the separating sword 66 is exactly in the path of movement of the counting articles 65 (FIGS. 1 and 9). In the separating position, the separating sword 66 stretches through the packaging batch 11, with at least the tip of the head 67, if not quite the entire head, projecting from the packaging batch 11 on the other side.

Arranged on the bottom part 71 of the separating sword 66, at the tip of the head 67 and on the side facing the fan disks 3, is a sensor 78 which is preferably designed as an optical sensor. This has a light guide 79 in the form of a glass-fiber cable, of which the end facing away from the sensor 78 is coupled optically, in a transducer housing 81, partly to a light source, for example, a luminous diode, and partly to an optoelectronic transducer. The sensor 78 thus works as a reflex light scanner. It is designed and arranged, as a whole, so that when a counting article 65 approaches the sensor 78, in particular makes contact with the latter, the sensor 78 transmits a control signal.

Figure 11:
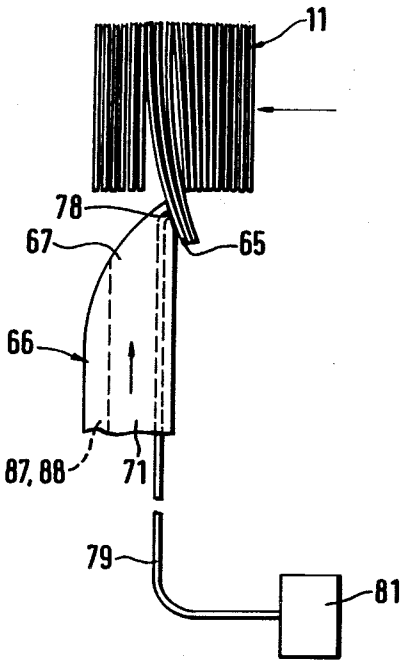

Inserted in the control of the drive of the holding head 75 is a delay element which transmits an actuating signal for driving the holding head 75 together with the separating sword 66 only a certain period of time after the control signal from the sensor 78 has appeared. Because of this, the separating sword 66 still remains in its position of rest for a short time, during which the packaging batch 11 outside that part of the counting article resting against the separating sword 66 and outside the individual articles adjacent to this counting article is pushed further by the following packaging batch 11 somewhat beyond the alignment of the separating sword 66. As a result, a gap forms between the counting article 65 and the individual articles downstream from it, as can be seen in FIG. 11. The separating sword is pushed further into this forming gap after the set delay time has elapsed, as a result of which the gap widens increasingly and finally the entire separating sword 66 extends through this gap and keeps the now separated stack 12 separate from the following packaging batch 11.

Figure 10:
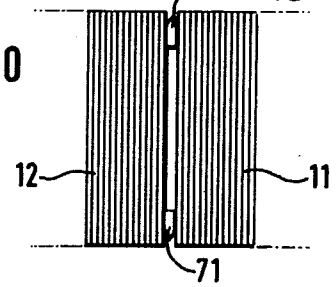
FIG. 10 is an end view of the separating sword in the separating position between a stack shown in cut-out form and the following packaging batch, shown in cut-out form.

When the separating sword 66 is in the separating position, the top part 72 is raised parallel to itself, the stack 12 thereby also being separated from the following packaging batch 11 in its upper region (FIG. 10).

In the temporarily delimited build-up space between the introduced separating sword 66 and the fan disks 3, the additional individual articles are added by the latter to the already present individual articles of the packaging batch 11 and are lined up.

The separated stack 12 is subsequently shifted toward the container 9 transversely relative to its previous direction of movement by the transfer arrangement 7 and is finally pushed completely into the container 9.

Figure 15:
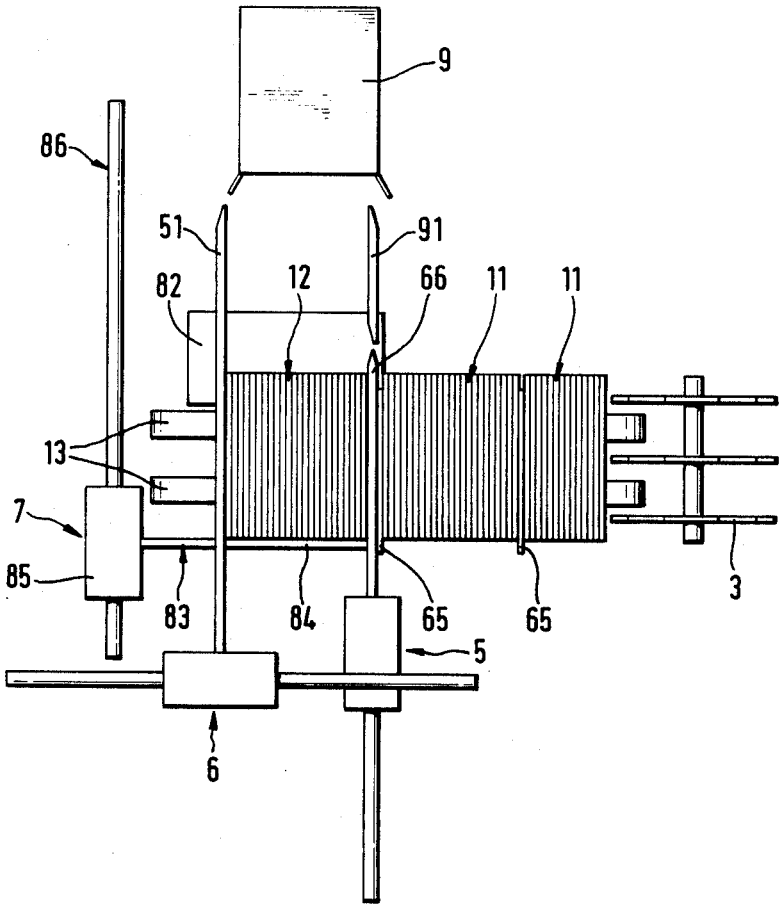
FIG. 15 is a diagrammatic plan view of a transfer arrangement of the automatic packaging machine in the final phase of the separating operation.

The transfer arrangement 7 is designed as a shifting arrangement. It has a slide track 82 for the stack 12 which extends from the delivery belts 13 to the filling station of the container 9 (FIG. 15). The transfer or shifting arrangement 7 has a shifting rake 83 with two prongs 84 (FIG. 15 and FIG. 1). The two prongs 84 are fastened above one another to a carrying body 85 guided on a longitudinal guide 86 so as to be shiftable in the horizontal direction, the shifting direction being aligned at right angles to the path of movement of the two delivery belts 13. The prongs 84 extend past the supporting strips 51 of the stack support 6, specifically either above or below the supporting strips or through an interspace between every two supporting strips 51 adjacent to one another, up to the separation point with the separating sword 66. The free ends of the prongs 84 in this case extend right into the region of horizontal projection of the separating sword 66.

Figure 14:
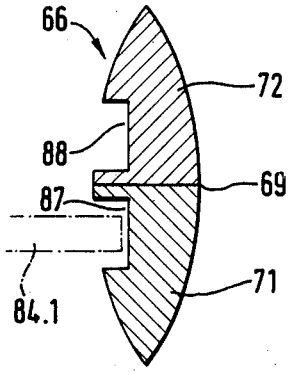
FIG. 14 is a cross-section through the separating sword.

The bottom part 71 and the top part 72 of the separating sword 66 each have, on the side facing the shifting rake 83, a longitudinal groove 87 and 88 (FIG. 14), these being aligned parallel to the horizontally aligned longitudinal axis of the separating sword 66 and parallel to its path of movement. The longitudinal grooves 87 and 88 open out freely at the two ends of the separating sword 66.

The cross-section of the two longitudinal grooves 87 and 88 has a height greater than the height of the prongs 84 of the shifting rake 83. The two prongs are designated by 84.1 and 84.2 to differentiate better between them. The lower prong 84.1 is arranged at the same height as the longitudinal groove 87 in the bottom part 71 (FIG. 13). The upper prong 84.2 is arranged at that height which the longitudinal groove 88 of the top part 72 assumes when the top part 72 of the separating sword 66 is in the raised separating position designated by 72' in FIGS. 9 and 10. Since the top part 72 is moveable into positions of differing height, the upper prong 84.2 is likewise connected to the carrying body 85 so as to be adjustable in terms of its height In the carrying body 85 there are, once again, sliding bushings which slide on the round rods of the longitudinal guide 86. As a drive for the shifting rake 83 there is a toothed belt (not shown) guided round two toothed-belt pulleys mounted rotatably on the two pillars of the longitudinal guide 86, of which only one pillar 89 is shown in FIG. 1 for the sake of clarity. One of these two toothed-belt pulleys is driven by an electric motor.

During the time when the stack 12 is separated from the following packaging batch 11 by the separating sword 66 and subsequently the top part 72 of the separating sword 66 is raised, the stack support 6 moves continuously further away from the separation point together with the delivery belts 13 continuing to run. Because no further individual articles are added to the rear end of the stack any longer because of the separating sword 66, and because the delivery belts 13 continue to run, the stack can expand and loosen at least in its upper regions.

Arranged in the region of horizontal projection of the stack 12 (FIG. 15) is a vibrating device of which the vibrating table (not shown) is built into the delivery table 4. The upper strand of the delivery belts 13 rests on the vibrating table. The vibrating table is appropriately arranged at such a height that, even at the lower point of reversal of the vibrating movement, its top side is no lower than the top side of the delivery table 4.

Before the start of vibration, the shifting rake 83 moves out of its rest position, in which it is next to the stack 12 at a slight distance from it, up against the stack 12. While the stack 12 is being vibrated on the vibrating table, the shifting rake 83 moves further in the direction of the container 9. At the same time, the stack 12 rests against the prongs 84 of the shifting rake 83, so that under the loosening effect of the vibrating movement the side edge of all the individual articles of the stack 12 finally rests against the prongs 84 and all the individual articles are thus aligned flush with one another.

Figure 16:
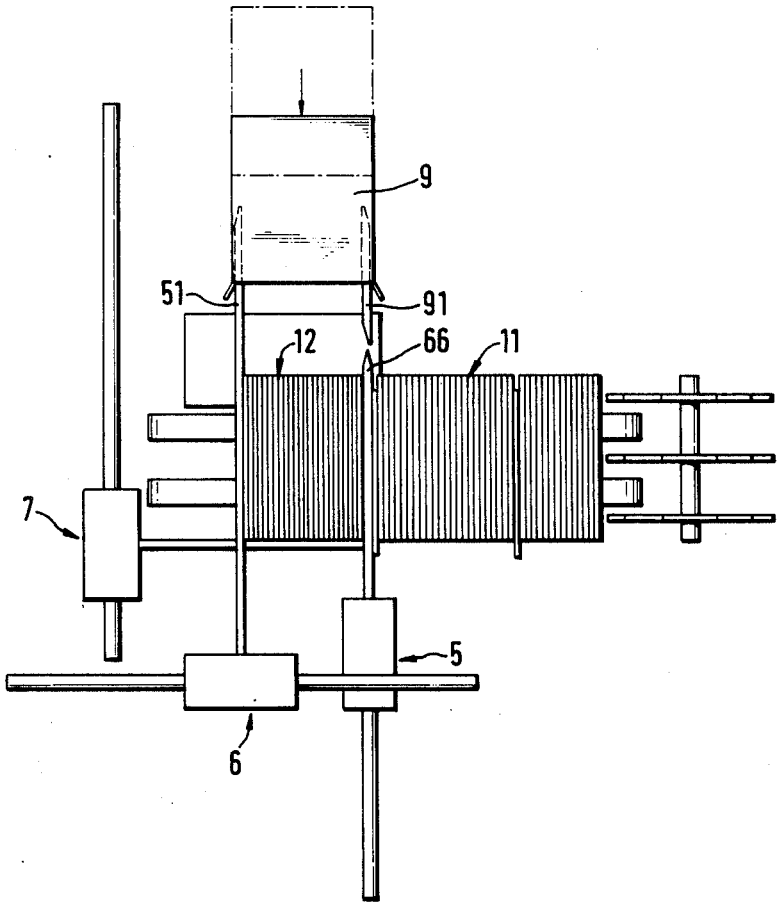
FIG. 16 is a diagrammatic plan view of the transfer arrangement in the initial phase of the transfer operation.

Even during the vibration, the stack support 6 is being moved back out of its temporary end position (FIG. 15) towards the separating sword 66 into a transfer position (FIG. 16). The stack 12 is thereby compressed in the longitudinal direction, specifically in the opposite direction to its original conveying movement on the delivery belts 13, to such an extent that its longitudinal extension is less than the clear width of the container 9. In this state, the stack 12 is pushed towards the container 9 over and beyond the slide track 82 by the shifting arrangement 7 by means of the shifting rake 83 (FIG. 17) and is finally pushed into the container.

Figure 17:
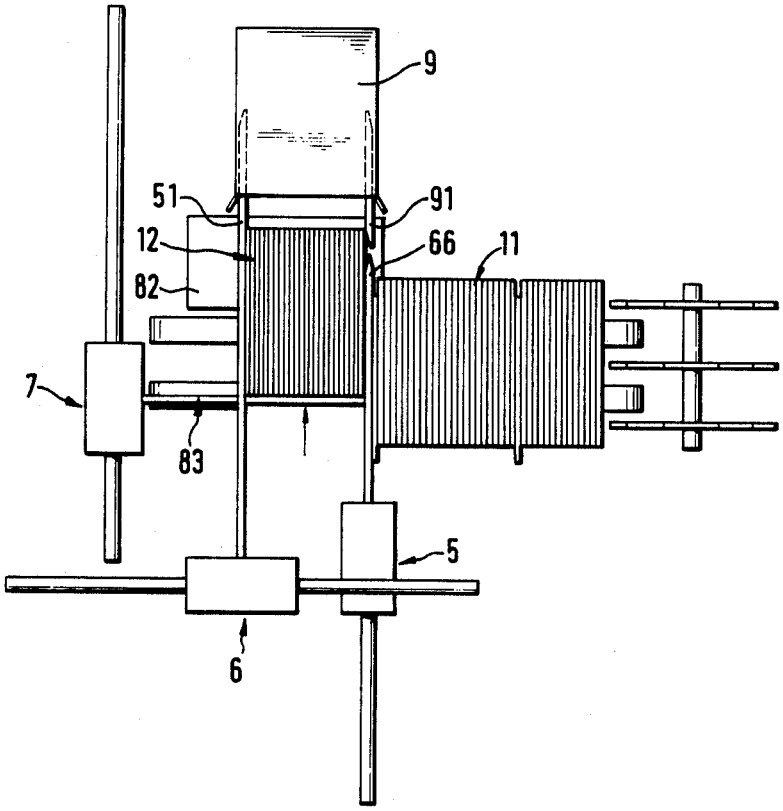
FIG. 17 is a diagrammatic plan view of the transfer arrangement in an intermediate phase of the transfer operation.

During the transfer of the stack 12, the supporting strips 51 of the stack support 6 and the two parts of the separating sword 66 serve as end-face guides for the stack 12. Since the separating sword 66 projects only a little beyond the width of the stack 12, there is arranged in alignment with each of its two parts a further strip-shaped guide element 91 which takes over the guiding job of the separating sword 66 during the further course of the transfer movement of the stack 12 (FIG. 17). In the transfer direction of the stack 12, these strip-shaped guide elements or, in brief, guide strips 91 extend at least approximately as far away from the delivery belts 13 as the supporting strips 51 of the stack support 6. The guide strips 91 and the supporting strips 51 extend up to a point which is further away from the original path of movement of the stack 12 than the container 9 is deep. Consequently, when the stack support 6 is being moved into the transfer position (FIG. 16), the container 9 can be pushed onto the guide strips 91 and the supporting strips 51 until its bottom comes up against the ends of these, without it coming up against the stack 12 beforehand. In FIGS. 16 and 17, the container 9 is shown pushed on only partially for the sake of clarity.

The stack 12 is pushed beyond the intermediate position as shown in FIG. 17 into the container 9 completely by the shifting rake 83. At the same time, the shifting rake 83 also moves a certain distance beyond the pushing-in position and thereby pushes both the stack 12 and the container 9 down from the guide strips 91 and supporting strips 51. As a result, even the individual articles on the end faces of the stack 12 remain in a position flush with the rest of the stack 12, although they are moved relative to the supporting elements 51 and relative to the guide strips 91 and a frictional force directed out of the container 9 is thereby exerted on them. The additional shifting distance of the rake 83 is therefore at least equal to the depth of penetration of the guide strips 91 and of the supporting strips 51 or, in other words, at least equal to the depth of the container 9.

Figure 18:
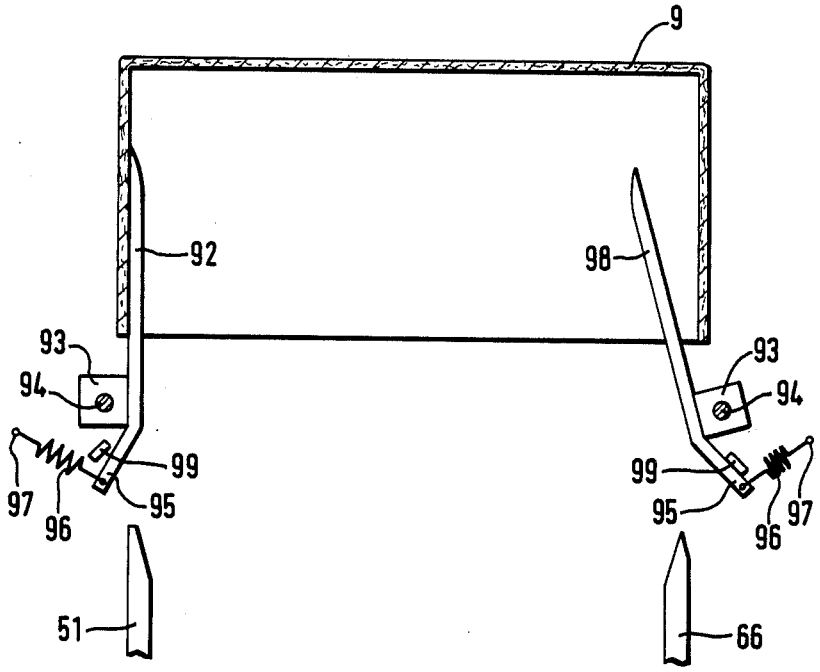
FIG. 18 is a plan view of a modified part of the transfer arrangement together with a container.

FIG. 18 illustrates a modified embodiment of those parts which guide the stack 12 on its two end faces when it is pushed into a container 9. Here, the supporting strips of the stack support 6, as supporting strips 51', extend towards the filling point of the container 9 only approximately as far as the separating sword 66 does. Arranged in alignment with the supporting strips 51' are strip-shaped guide elements or guide strips 92 which act as an extension of the supporting strips 51' and which accordingly extend right into the container 9. The guide strips 92 are fastened, in the end region facing away from the container 9 to a common holder 93 mounted pivotably about a vertical pivot axle 94. Suspended on that end portion 95 of one of the guide strips 92 which extends beyond the holder 93 is a tension spring 96, the other end 97 of which is supported on a fixed part of the automatic packaging machine 1. The tension spring 96 exerts on the guide strips 92 a torque which causes them to pivot toward the interior of the container, as shown for the guide strips 98 in alignment with the separating sword 66. Arranged fixed in place in the path of movement of the end portion 95 is a stop 99, against which the end portion 95 comes to rest when the guide strips 92 are pivoted through a pivoting angle of approximately 5 to 10 degrees relative to the alignment of the supporting strips 51'. The end portion 95 on the guide element 92 and on the guide element 98 is angled outwardly slightly relative to the alignment of the latter, to provide a run-in slope for the stack 12.

The guide strips 98 are designed in the same way as the guide strips 92 and are simply arranged pivoted at 180°, the explanations relating to the guide strips 92 therefore applying accordingly to these.

The pushing-in position of the stack support 6 and of its supporting strips 51' depends on the length of the stack 12. Where the stack support 6 is concerned, this is taken into account by corresponding control of its drive. The guide strips 92, which are separate from this, have to be adjusted in the direction of the longitudinal extension of the stack 12 when the length of the stack 12 and consequently also the length of the container 9 change. The simplest way of achieving this is to arrange the pivot axle 94 on a slide which can be adjusted parallel to the longitudinal guide 45 of the stack support 6 by means of a longitudinal guide.

After the stack 12 has been pushed into the container 9 and both the stack and the container have been pushed off of the supporting strips 51 and the guide strips 91, the shifting rake 83 is moved back into its initial position or rest position (FIG. 1), in which its prongs 84 are on the same side as the separating device 5 next to the path of movement of the packaging batch 11. At the same time, the stack support 6 is moved back from the transfer position to the separating sword 66 waiting in the separating position. The separating sword 66 is moved out of the path of movement of the packaging batch 11 back into its rest position (FIG. 1), after which the stack support 6 once again takes over the job of supporting the front end face of the packaging batch 11 by means of its supporting strips 51 and again moves ahead of this in steps toward the transfer position.

The correct interaction of all the parts of the automatic packaging machine 1 becomes easier if the separating device 5, the stack support 6 with its stand 46 and the shifting arrangement 7 are arranged on a common base stand 100 which is indicated in FIG. 1, for the sake of clarity, merely as a relatively small plate which in reality has the form of a stand. This base stand 100 and the delivery table 4 are connected releasably to one another. Because of this, if required, the part of the automatic packaging machine 1 combined with the base stand can be detached from one production machine and attached to another production machine, insofar as the work table of the latter is of the same type as the work table 4.

Figure 19:
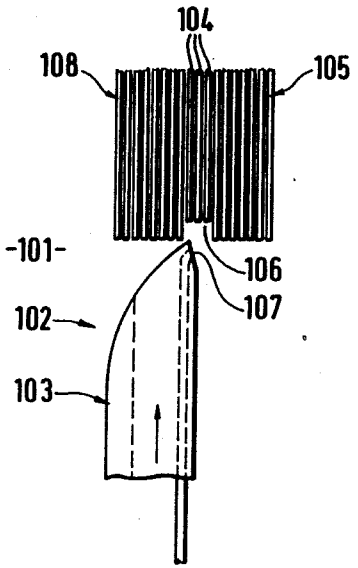
FIG. 19 is a plan view, in cut-out form, of the second exemplary embodiment of the automatic packaging machine with a separating sword.
Figure 12:
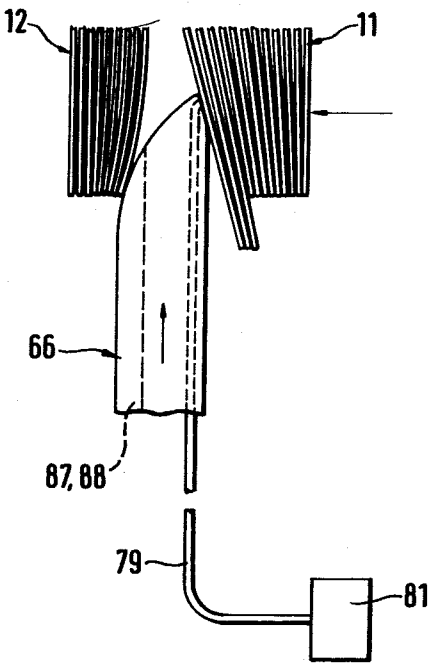
FIGS. 11 and 12 are plan views, in cut-out form, of the separating sword at the packaging batch in two different phases of the separating operation.

In the second exemplary embodiment, shown in isolated form in FIG. 19, of an automatic packaging machine 101, the separating device 102 of which is likewise equipped with a separating sword 103, essentially only the manner in which the counting articles are detected is different, and this alone is explained below. Insofar as individual subassemblies or components are not explained in greater detail, it is to be assumed that they are designed and arranged in an identical or at least similar way to the corresponding subassemblies or components of the automatic packaging machine 1 and act in the same or a similar way.

The auxiliary device arranged in the output region of the fan disks of the production machine and intended for the separating device 102 is located on the same side as the separating device 102. This auxiliary device therefore shifts those individual articles of the packaging batch 105 which serve as counting articles 104 a certain distance toward the opposite side. As a result, on the same side as the separating device 102, a small primary gap 106 forms in the region of the counting articles 104 at the side of the packaging batch 105. The optical sensor 107 on the separating sword 103 is designed and arranged so that, when it encounters the primary gap 106, it responds to this and transmits a control signal. In reaction to this control signal, the control circuit of the automatic packaging machine 101 actuates the drive of the separating sword 103, specifically in such a way that the tip of the separating sword 103 is first moved into the primary gap 106 an amount corresponding at most to the depth of the latter, and subsequently the drive of the separating sword 103 is stopped or at least delayed for a short period of time. During this period of time, the individual articles of the packaging batch 105 which are adjacent to the primary gap 106 are halted in their edge region by the separating sword 103, while the rest of these individual articles are pushed further by the following individual articles. At the same time, the counting articles also move further with their edge, so that a secondary gap becoming larger and larger forms between them and the individual articles of the packaging batch 105 which are adjacent to them. As soon as this secondary gap has assumed a certain size after the set period of time has elapsed, the drive of the separating sword 103 is actuated again by the control circuit of the automatic packaging machine 101, and the separating sword 103 is pushed into the secondary gap and through the packaging batch 104.

The separating sword 103, like the separating sword 66, is made in two parts. After it has been pushed into the packaging batch completely, the top part of the separating sword 103 is raised to the upper region of the packaging batch 105 and the downstream portion of the packaging batch is thereby separated completely, as a stack 108, from the following packaging batch 105. The remaining operations for packaging the stack 108 take place in the same way as for the stack 12.

Figure 20:
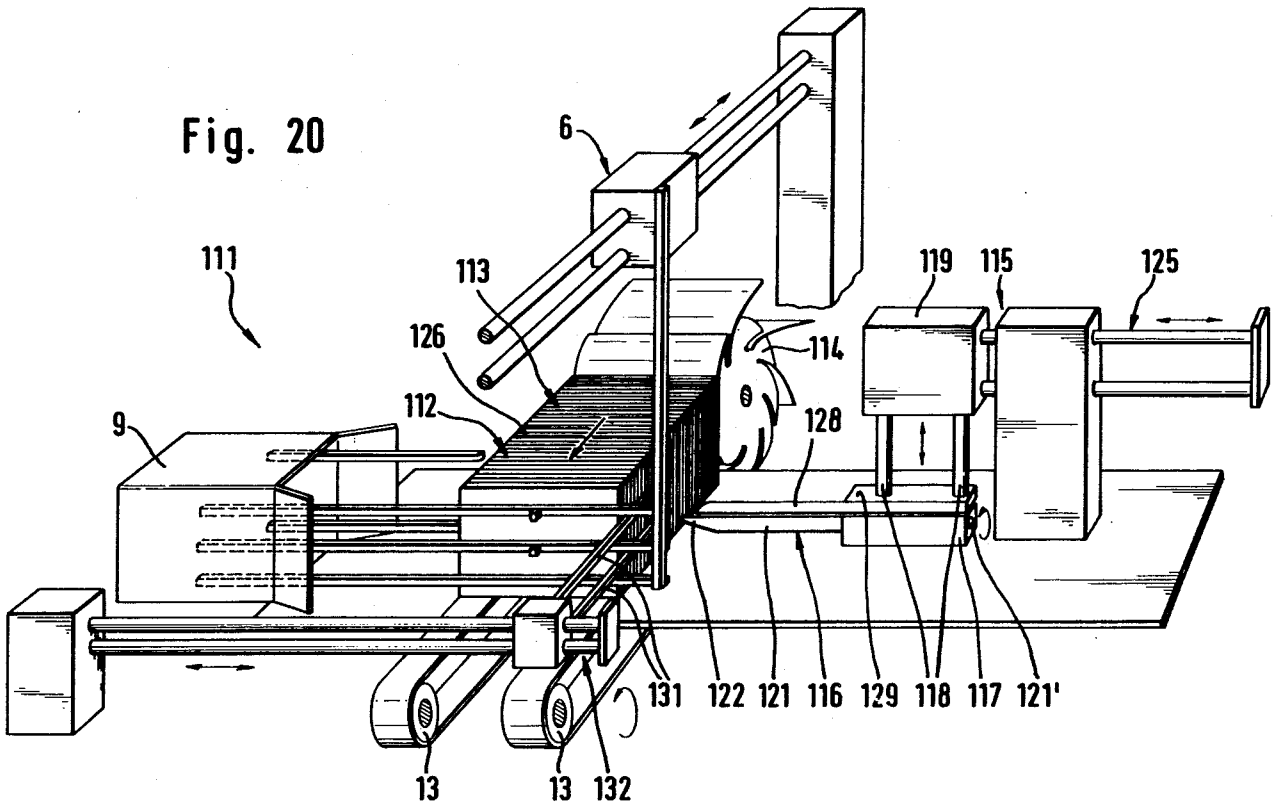
FIG. 20 is a diagrammatic perspective view of the third exemplary embodiment of the automatic packaging machine with a separating lance.

The automatic packaging machine 111 illustrated in FIG. 20 differs from the two automatic packaging machines 1 and 101 essentially only in the manner in which a stack 112 is separated from the following packaging batch 113. The automatic packaging machine 111 operates without a device by which one or more of the individual articles of the packaging batch 113 are otherwise pushed out of the row as counting articles. The automatic packaging machine 111 is therefore suitable for use on those production machines in which such a shifting device for counting articles is not provided and cannot even be installed subsequently.

The separating device 115 has a separating lance 116 which is mounted rotatably on a bearing body 117, the axis of rotation of the separating lance 116 being aligned horizontally and at the same time at right angles to the conveying direction of the packaging batch 113. The bearing body 117 is arranged on two spacers 118, via which it is connected firmly to the holding head 119.

Figure 21:
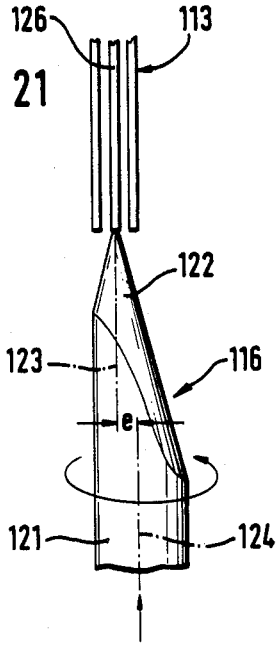
FIGS. 21 to 24 are plan views, in cut-out form, of the separating lance in different phases of the separating operation at the packaging batch.

The separating lance 116 has a cylindrical shank 121 and a conical head or, in brief, cone head 122. The cone axis 123 is offset a certain eccentric amount "e" relative to the cylinder axis 124 of the shank 121 (FIG. 21). This eccentric amount "e" is approximately 1 mm.

The separating lance 116 is driven to rotate by means of a drive (not shown) which is arranged at the rear end of the separating lance 116 on the bearing body 117 and which is coupled fixedly in terms of rotation to the end 121' of the separating lance 116. Here again, the holding head 119 is guided by means of a longitudinal guide 125 so as to be movable longitudinally in the same way and coupled to a longitudinal drive (not shown) in the same way as for the holding head 75 of the automatic packaging machine 1. The separating lance can thus be pushed out of its rest position, shown in FIG. 20, in which it is outside the packaging batch 113, through the packaging batch transversely to the path of movement of the latter until at least its cone head 122 projects on the other side of the packaging batch 113.

Figure 22:
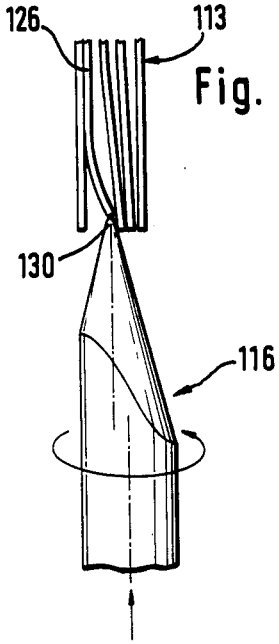
Figure 23:
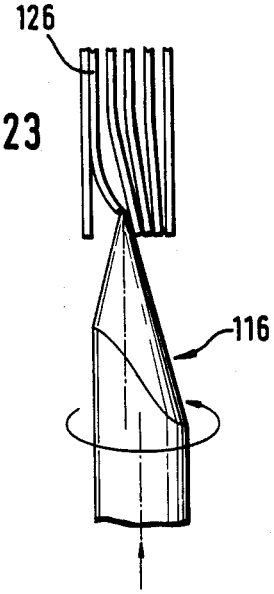
Figure 24:
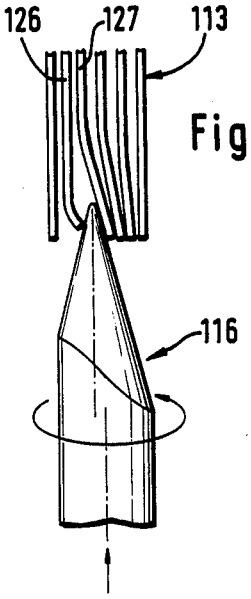

At the approach of an individual article of the packaging batch 113 which corresponds to a specific number of preceding individual articles and which can therefore be considered as a counting article 126, the longitudinal drive of the separating lance 116 is actuated in response to a corresponding counting signal from a sensor arranged in the region of the fan disks and similar to the sensor 24 on the automatic packaging machine 1. In the first phase of movement, the separating lance 116 is first moved up to the side edge of the packaging batch 113 (FIG. 21) and, furthermore, is moved a short distance further up against the packaging batch 113 (FIG. 22). The tip 130 of the cone head 122 circling eccentrically round the cylinder axis 124 presses either the counting piece 126 or the individual article adjacent to it on one side or the other either immediately sideways or, as shown in FIG. 2, initially into the packaging batch 113 somewhat at its edge, with the result that the edge region is deformed elastically and tensioned. Consequently, in the course of the further circular movement of the cone head 122, this side edge jumps off from the tip 130 (FIG. 23) and straightens itself again next to the cone head continuing to rotate (FIG. 24), so that, at the latest by this time, the cone head 122 has penetrated into the packaging batch 113 between the counting article 126 and one individual article 127 adjacent to it. As a result of the continuing circular movement of the cone head 122 and the further advance of the separating lance 116 as a whole, the latter moves through the entire packaging batch 113 and thereby separates the individual articles forming in the stack 112 from the following packaging batch 113, at least in the lower region.

The separating lance 116 is made in two parts in a similar way to the separating sword 66. Its top part 128 (FIG. 1) is fastened to a slide 129 in such a way that it is arranged vertically above the separating lance 116 which, as it were, forms its own bottom part. The underside of the top part 128 facing the separating lance 116 can be made hollow-cylindrical, so that, in the lowered position, it rests more closely against the separating lance 116.

The slide 129 is guided so as to be vertically movable on the spacers 118 serving as a longitudinal guide.

It is coupled to a longitudinal drive (not shown), by means of which it can be raised, together with the top part 128, into a position such as that which the top part 72 of the separating sword 66 can assume.

The rotating separating lance 116 has no longitudinal groove for the insertion of the free end of one of the prongs 131 of the shifting rake 132. In this case, one of these prongs 131 has to be arranged just below or just above the separating lance, so that it can nevertheless extend right into the region of horizontal projection of the separating lance 116. The non-rotating top part 128 is provided with a longitudinal groove, into which can penetrate the free end of that prong 131 which is at the height assumed by the respective longitudinal groove in the top part 128 when the latter is in the raised position corresponding to the position 72' of the top part of the separating sword 66 (FIGS. 9 and 10).

When the separating lance 116 has completely separated the stack 112 from the following packaging batch 113, the further operations for packaging the stack 112 into a container 9 take place in the same way as on the automatic packaging machine 1.

The target accuracy of the separating device 115 is somewhat less than that of the separating device 5 of the automatic packaging machine 1. Because of this, the automatic packaging machine 111 with the separating device 115 can also be used on those production machines in which the device for shifting counting articles is not provided and cannot be installed.

Figure 25:
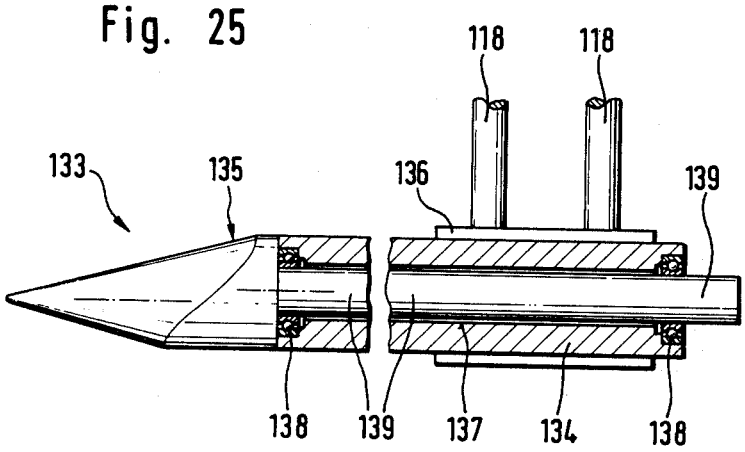
FIG. 25 is a partial sectional side view of a modified embodiment of the separating lance.
Figure 26:
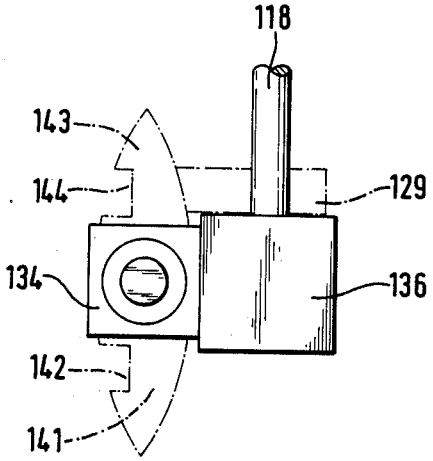
FIG. 26 is a cross-section through the separating lance according to FIG. 25.

FIGS. 25 and 26 show a modified embodiment of the separating lance, in which the separating lance 133 is made in two parts and has a shank 134 and a conical head 135 as independent parts. The shank 134 is fastened rigidly to a carrying body 136 which, in the rotatable separating lance 116, corresponds to the bearing body 117. Like this, the carrying body 136 is arranged on two spacers 118, via which it is connected to the holding head of the separating device.

The shank 134 can have any cross-section, for example a square or a rectangular cross-section (FIG. 26). It is designed as a hollow body and has a through-hole 137 extending centrally relative to its longitudinal axis. Arranged centrally relative to the through-hole 137 at both ends of the shank 134 are two bearings 138. Mounted on these is a shaft 139, on the front end of which the conical head 135 is arranged. At the opposite end, the shaft 139 is coupled to a rotary drive which is fastened to the carrying body 136 and which is not shown in FIG. 25. At the end region adjacent to the cone head 135, the outer face of the shank 134 is matched to the circular-cylindrical end region of the cone head 135, in order to avoid end faces against which the packaging batch could bump.

If the horizontally measured outer dimension of the cross-section of the shank 134 is only slightly greater than the inner dimension of the lo through-hole 137, it is expedient to equip the shank 134 on the underside with a keel-like extension 141 indicated by dot-and-dash lines in FIG. 26. In the region of this extension 141, on the side facing the shifting rake (FIG. 20) there can be a longitudinal groove 142, with which a prong of the shifting rake 132 can be aligned in such a way that its free end extends into the vertical projection of the groove 142.

As with the separating lance 116, the separating lance 133 too can be equipped with a top part 145 which can likewise have a longitudinal groove 146, with which a prong of the shifting rake 132 is aligned when the top part is in the raised operating position. For this purpose, the top part 145 is connected to a lifting device for which the spacers 118 serve as a longitudinal guide.

As illustrated in FIG. 16, the containers 9 could be pushed onto the guide elements in the form of the guide strips 91 and supporting strips 51 by hand. Since the empty container 9 has to be pushed onto these guide elements and the full container 9 removed from them within relatively short periods of time and exactly in time with the other work cycles of the automatic packaging machine 1, the handling arrangement 8 is used for handling the containers 9 and is likewise controlled by the control circuit of the automatic packaging machine. It is explained below with reference to FIGS. 27 to 34.

Figure 27:
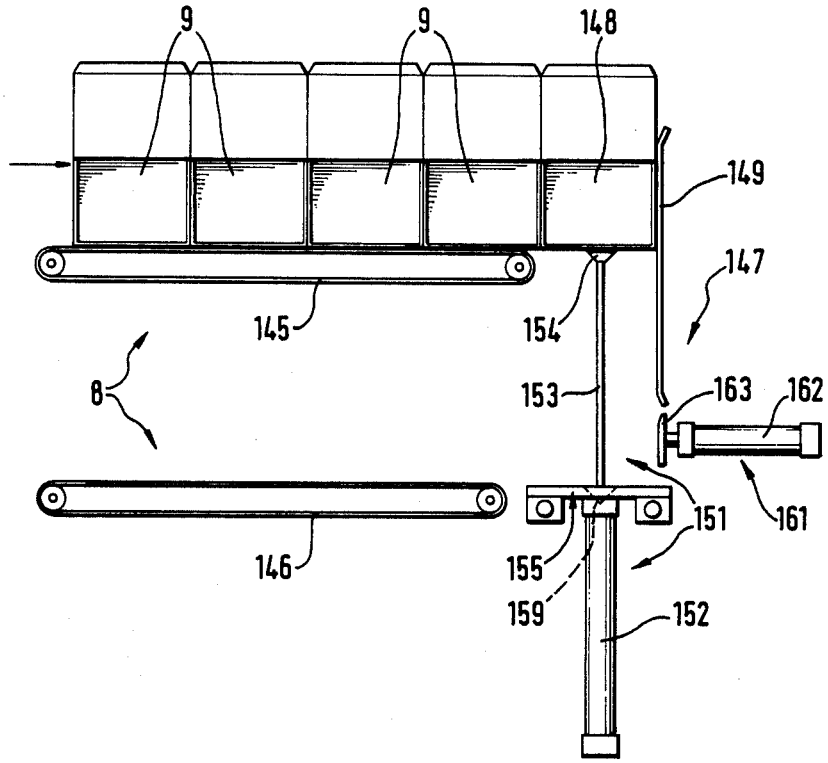
FIGS. 27 and 28 are, respectively, a diagrammatic side view and a plan view of a handling arrangement for the containers in a first phase of movement.

The handling arrangement 8 has two conveyor belts 145 and 146. The conveyor belt 145 serves for feeding the empty containers 9 to a change-over device 147. The conveyor belt 146 serves for transporting the filled containers 9 away from the change-over device 147 (FIGS. 33 and 34) to a stacking area or to a further conveyor arrangement. The two conveyor belts 145 and 146 terminate above the change-over device 147 just in front of the region of horizontal projection of the last of the empty containers 9 supplied (FIG. 27). So that the foremost container 148 also remains standing at the correct location above the change-over device 147 in the conveying direction of the conveyor belt 145, there is arranged in the path of movement of the containers 9 a stop plate 149 which is aligned vertically and which later serves at the same time as a guide for the container 148 during the lowering movement. The stop plate 149 is arranged fixedly in the conveying direction of the conveyor belt 145, so that the side wall of the containers 9 which faces the production machine 2 is always set in alignment with the separating device 5.

The change-over device 147 includes a vertical conveyor 151 having a pneumatic piston drive 152 with a piston rod 153, on the upper end of which is arranged a suction head 154. The conveying height of the vertical conveyor 151 corresponds to the height difference between the upper conveyor belt 145 and the conveyor belt 146 located underneath this. The suction head 154 can be connected to a vacuum generator via the piston rod 153.

Arranged at the height of the conveyor belt 146 is a sliding table 155. This is moveable horizontally on a longitudinal guide by means of two guide rods 156, the direction of movement of the sliding table 155 being parallel to the alignment of the guide strips 91 and supporting elements 51 (FIG. 15).

The table plate 157 of the sliding table 155 has, on the side facing away from the automatic packaging machine, a recess 158 which has a U-shaped contour, as seen in horizontal projection, and which is open towards the side facing away from the automatic packaging machine. The area of the recess 158, as seen in horizontal projection, is slightly larger than the relative range of movement of the vertical conveyor 151, which arises because the sliding table 155 is moved relative to the vertical conveyor 151 into the take-over position for the container 148, shown in FIG. 28, in which the vertical conveyor 151 is at least approximately in the geometrical center of the sliding table 155. The sliding table 155 has, in the surface region facing the automatic packaging machine, a suction cup 159 which is arranged on the bisecting line of the sliding table 155 aligned with the recess 158.

Instead of the change-over device 147, it is also possible to use a modified change-over device 147', the parts of which are hereafter distinguished from the corresponding parts of the change-over device 147 by reference symbols with an apostrophe.

In the change-over device 147', the vertical conveyor 151' is not arranged fixed in place, but is combined with the sliding table 155 which now has in its table plate 157' only a circular recess for the vertical conveyor 151'. A further modification is that the second suction head 159' is combined with the suction head 154' of the vertical conveyor 151' to form a double suction head which is arranged on the piston rod 153' of the vertical conveyor 151'. In this change-over device 147', the container 148, after being put down on the sliding table 155, is no longer released from the vertical conveyor 151', but is retained uninterruptedly by its double suction head 154'/159' during the following operations, until the sliding table 155 has returned to its initial position and consequently the container 148 has arrived at the point of transfer to the lower conveyor belt 146. After the double suction head 154'/159' has been shut off, the container can be pushed over onto the conveyor belt 146' by the shifting device 161'.

In the take-over position of the sliding table 155, a shifting device 161 is arranged on the side facing away from the conveyor belt 146. It has a pneumatic piston drive 162, to the piston rod of which is fastened a shifting plate 163. The shifting device is arranged at least approximately in the longitudinal center line of the conveyor belt 146 and is aligned with it. The shifting plate 163 is aligned transversely relative to this. In terms of height, the shifting device 161 is aligned at least approximately with the lower region of the containers 9 resting on the sliding table 155. The shifting travel of the shifting device 161 extends over at least up to the conveyor belt 146.

Figure 28:
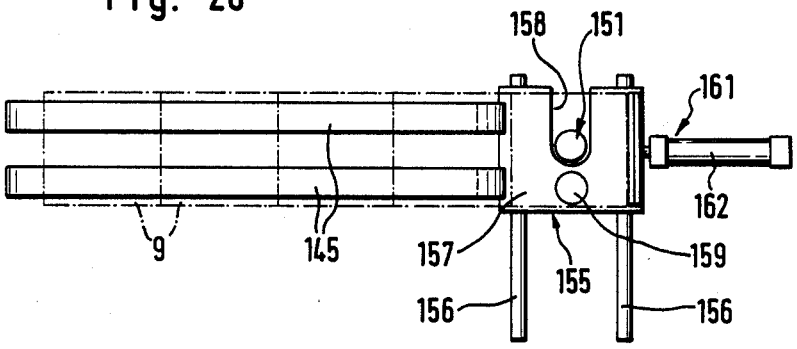
Figure 29:
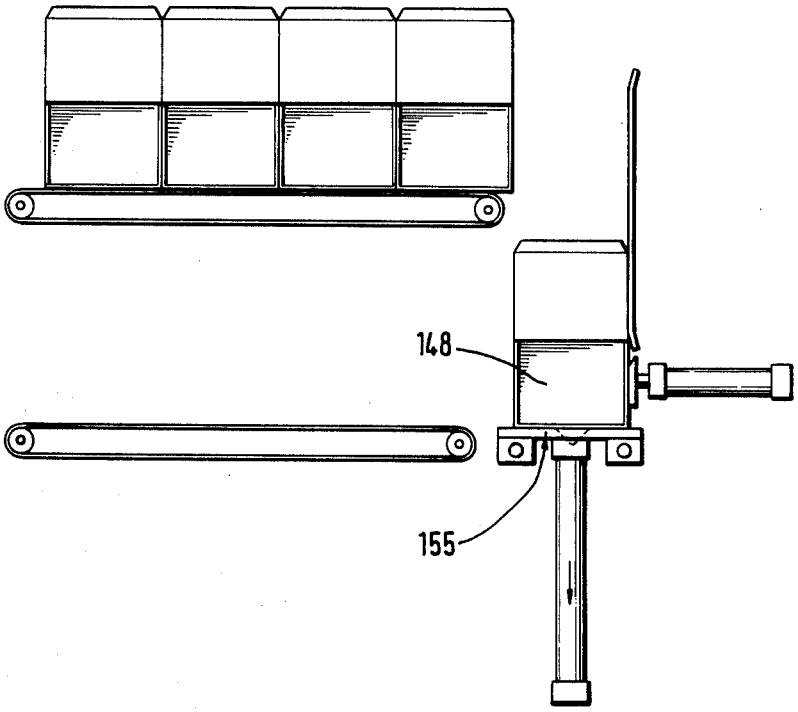
FIGS. 29 and 30 are, respectively, a diagrammatic side view and a plan view of the handling arrangement in a second phase of movement.
Figure 30:
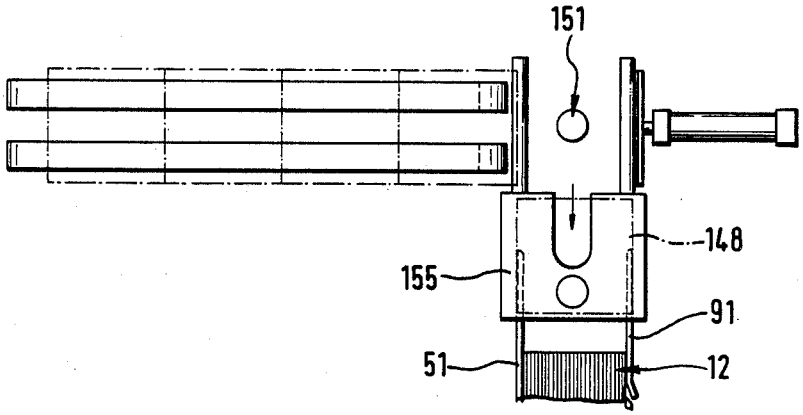
Figure 31:
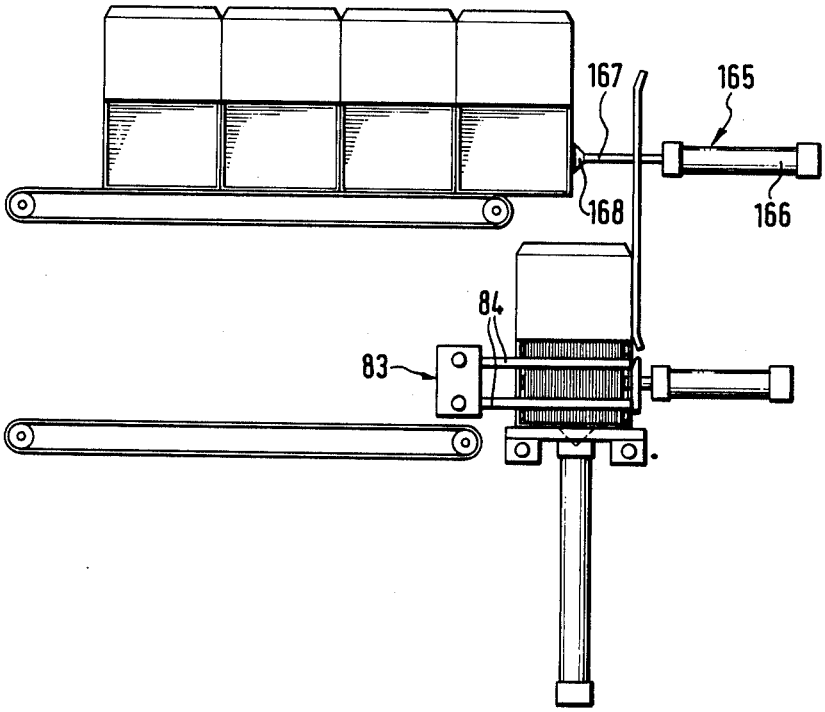
FIGS. 31 and 32 are, respectively, a diagrammatic side view and a plan view of the handling arrangement in a third phase of movement, with parts of the transfer arrangement.
Figure 32:
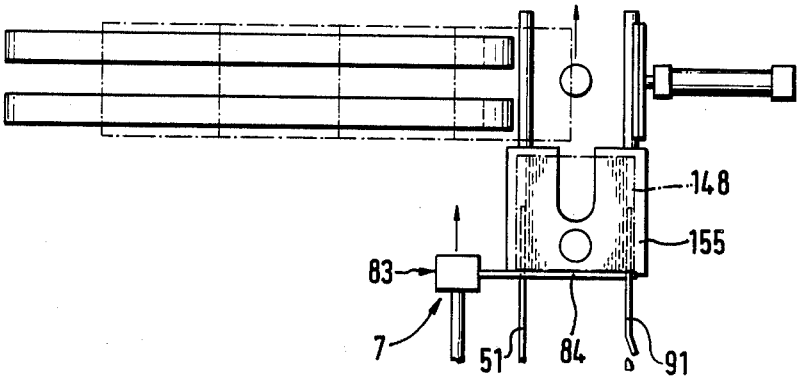
Figure 33:
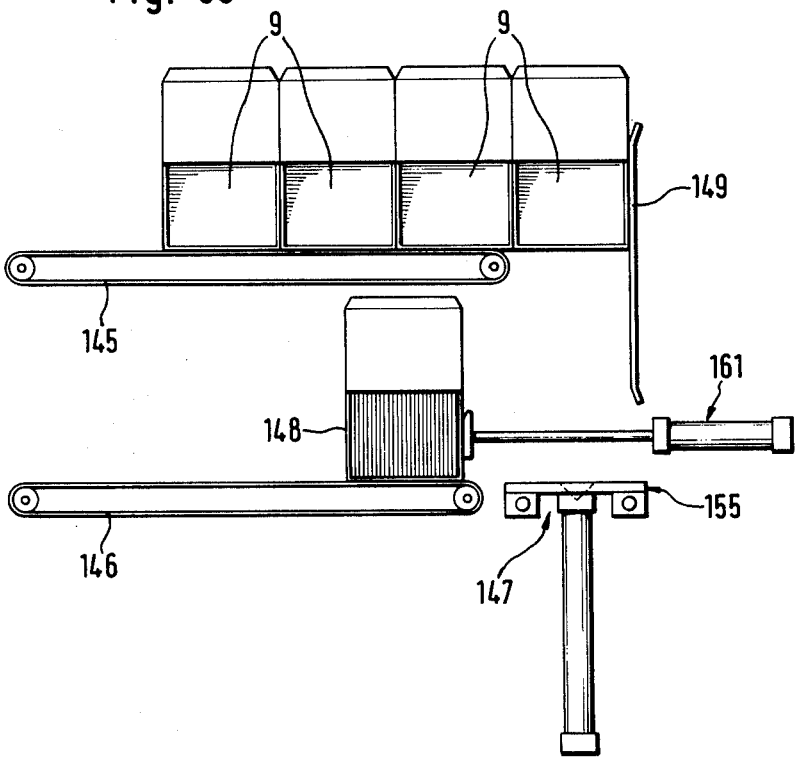
FIGS. 33 and 34 are, respectively, a diagrammatic side view and a plan view of the handling arrangement in a fourth phase of movement.
Figure 34:
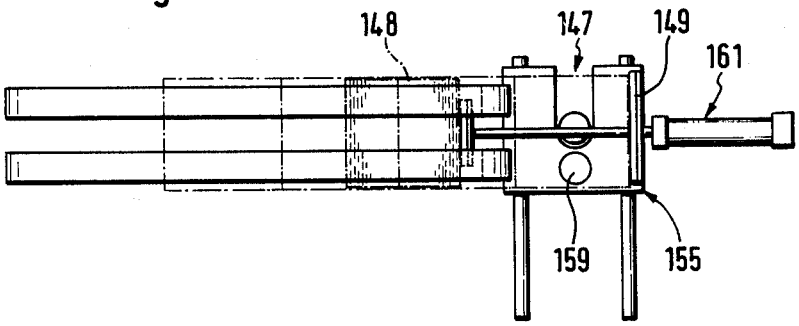

The handling of the foremost container 148 brought up by the conveyor belt 145 is explained below: the piston rod 153 is raised up to container 148, so that the suction head 154 rests against the bottom of the container 148. The suction head 154 is connected to the vacuum generator via a valve actuated by the control circuit. As a result of the pressure difference occurring thereby between the top side and under side of its bottom, the container 148 is pressed against the suction head 154 and, as it were, sucked up by it. The piston rod 153 is retracted downwardly and as a result the container 148 is lowered onto the sliding table 155 standing in the take-over position (FIG. 30). The suction cup 159 on the sliding table 155 is now likewise connected to the vacuum generator by the control circuit via a valve, whereupon, shortly thereafter, the suction head 154 on the piston rod 153 is cut out again. The container 148 is thereby retained on the sliding table 155. At the moment when the stack support 6 has already compressed the stack 12 by means of its supporting strips 51 and has reached its transfer position (FIG. 16), the sliding table 155 is shifted, together with the container 148, toward the automatic packaging machine into the filling position which it has not yet reached completely in FIGS. 16 and 17. The stack 12 guided by the guide strips 91 and the supporting strips 51 is pushed into the container 148 completely by the shifting rake 83 (FIG. 32), and subsequently the container 148, together with the sliding table 155, is pushed back until the guide strips 91 and the supporting strips 51 have come out of the filled container 148 completely. Subsequently, the sliding table 155 is pushed back into the take-over position by a longitudinal drive (not shown) (FIGS. 28 and 34). The suction cup 159 is cut out and the filled container 148 is pushed down from the sliding table 155 and over onto the conveyor belt 146 by means of the shifting device 161 (FIGS. 33 and 34).

The container 148 can be prepared for take-over by the vertical conveyor 151 by stopping the conveyor belt 145 whenever the suction head 154 of the vertical conveyor 151 is in the raised take-over position shown in FIG. 26. The suction head 154 then serves at the same time as a support for the container 148. It is preferable, however, to provide a transfer device 165 which, for the sake of clarity, is only shown in FIG. 31. It has a piston drive 166 which, in the direction of the path of movement of the containers 9 located on the conveyor belt 145, is arranged on the far side of the stop plate 149 and the piston rod 147 of which reaches through a recess in the stop plate 149 up to the conveyor belt 145. A suction head 168 is arranged on the end of the piston rod 167. By means of this suction head 168, the foremost of the containers 9 is grasped on the conveyor belt 145 and drawn over or, more exactly, lifted over into the transfer position (FIG. 27), in which it is designated as the container 148. As soon as the vertical conveyor 151 has taken over t he container 148, the suction head 148 of the transfer device 165 is shut off.

What is claimed is:

1. A process for packaging into a container envelope-like articles which exit serially from a production machine, comprising the steps of:

serially collecting a packaging batch comprising a plurality of envelope-like articles;

counting the envelope-like articles to identify periodically an individual article of the packaging batch which corresponds to a specific batch size of a stack to be packaged, said individual article constituting a counting article, wherein said counting step further comprises moving the counting article a predetermined distance laterally with respect to the conveying direction so that it protrudes;

conveying the packaging batch at least semi-continuously in a conveying direction in relation to the further individual articles which are supplied to the packaging batch;

moving a supporting part in the conveying direction in front of the head of the packaging batch at a speed equal to supply of the further individual articles to the packaging batch to thereby keep the batch at least approximately vertical;

when the counting article arrives at a separation point located at a predetermined distance in the conveying direction, inserting a separating part transversely relative to the conveying direction of the batch between adjacent envelope-like articles at least in the vicinity of the counting article, to define the stack and temporarily stop a portion of the packaging batch upstream of the stack, wherein said inserting step comprises first engaging and halting the protruding counting article at one edge with the separating part, whereupon a gap is formed downstream of the Counting article, and thereafter inserting the separating part into the gap;

after the separating part has been inserted between the stack and the upstream portion of the packaging batch, moving the supporting part a predetermined distance in a direction opposite to the conveying direction to thereby compress the stack to a stack length which is less than the horizontally measured width of the container;

filling the compressed stack into the container in a direction transverse to the conveying direction; and after the stack has been transferred into the container, moving the supporting part to the separation point and retracting the separating part out of the path of movement of the upstream portion of the packaging batch.

2. A process as claimed in claim 1, further comprising the step of vibrating in a vertical direction the stack during at least the first portion of said step of filling the container and contacting the stack on the side facing away from the container to align all edges of the envelop-like articles flush.

3. A process as claimed in claim 2, wherein said vibrating step further comprises, at the start of the vibration step, moving the supporting part a certain distance away from the separating part, and thereafter, during or after the vibration phase, moving the supporting part in the direction of the separating part to thereby again compress the stack.

4. A process as claimed in claim 1, further comprising the steps of pushing the container onto guide elements which are arranged in alignment with the separating part, moving the stack during said filling step a distance which exceed the container depth by an amount sufficient to push the container, together with the stack, off from the guide elements, and thereafter conveying the filled container away from the point of filling.

5. A process for packaging into a container envelope-like articles which exit serially from a production machine, comprising the steps of:

serially collecting a packaging batch comprising a plurality of envelope-like articles;

counting the envelope-like articles to identify periodically an individual article of the packaging batch which corresponds to a specific batch size of a stack to be packaged, said individual article constituting a counting article;

conveying the packaging batch at least semi-continuously in a conveying direction in relation to the further individual articles which are supplied to the packaging batch;

moving a supporting part in the conveying direction in front of the head of the packaging batch at a speed equal to supply of the further individual articles to the packaging batch to thereby keep the batch at least approximately vertical;

when the counting article arrives at a separation point located at a predetermined distance in the conveying direction, inserting a separating part transversely relative to the conveying direction of the batch between adjacent envelope-like articles at least in the vicinity of the counting article, to define the stack and temporarily stop a portion of the packaging batch upstream of the stack;

after the separating part has been inserted between the stack and the upstream portion of the packaging batch, moving the supporting part a predetermined distance in a direction opposite to the conveying direction to thereby compress the stack to a stack length which is less than the horizontally measured width of the container;

filling the compressed stack into the container in a direction transverse to the conveying direction;

after the stack has been transferred into the container, moving the supporting part to the separation point and retracting the separating part out of the path of movement of the upstream portion of the packaging batch; and wherein said counting step further comprises moving at least the counting article a predetermined distance laterally with respect to the conveying direction to produce a primary gap on the side of the packaging batch facing the separating part, and wherein said inserting step comprises first inserting the separating part into said primary gap to engage and halt at one edge the envelope-like articles upstream of said primary gap, whereupon a secondary gap is formed downstream of the separating part, and thereafter inserting the separating part into said secondary gap.

6. A process as claimed in claim 5, further comprising the step of vibrating in a vertical direction the stack during at least the first portion of said step of filling the container and contacting the stack on the side facing away from the container to align all edges of the envelop-like articles flush.

7. A process as claimed in claim 6, wherein said vibrating step further comprises, at the start of the vibration step, moving the supporting part a certain distance away from the separating part, and thereafter, during or after the vibration phase, moving the supporting part in the direction of the separating part to thereby again compress the stack.

8. A process as claimed in claim 5, further comprising the steps of pushing the container onto guide elements which are arranged in alignment with the separating part, moving the stack during said filling step a distance which exceed the container depth by an amount sufficient to push the container, together with the stack, off from the guide elements, and thereafter conveying the filled container away from the point of filling.

9. A machine for packaging into a container envelope-like articles which exit serially from a production machine, comprising:

means for serially collecting a packaging batch comprising a plurality of envelope-like articles;

means for counting the envelope-like articles to identify periodically an individual article of the packaging batch which corresponds to a specific batch size of a stack to be packaged, said individual article constituting a counting article;

means for conveying the packaging batch at least semi-continuously in a conveying direction in relation to the further individual articles which are supplied to the packaging batch;

a supporting part positioned above said conveying means, for keeping the packaging batch at least approximately vertical;

means for moving the supporting part in the conveying direction in front of the head of the packaging batch at a speed equal to supply of the further individual articles to the packaging batch;

means for inserting a separating part transversely relative to the conveying direction of the batch between adjacent envelope-like articles at least in the vicinity of the counting article, when the counting article arrives at a separation point located at a predetermined distance in the conveying direction, to define said stack and temporarily stop a portion of the packaging batch upstream of the stack;

means for moving the supporting part a predetermined distance in a direction opposite to the conveying direction, after the separating part has been inserted between the stack and the upstream portion of the packaging batch, to thereby compress the stack to a stack length which is less than the horizontally measured width of the container; and means for filling the compressed stack into the container in a direction transverse to the conveying direction.

10. A machine as claimed in claim 9, wherein said counting means further comprises means for moving the counting article a predetermined distance laterally with respect to the conveying direction so that it protrudes, and wherein said inserting means comprises means for first engaging and halting the protruding counting article at one edge with the separating part, whereupon a gap is formed downstream of the counting article, and means for thereafter inserting the separating part into the gap.

11. A machine as claimed in claim 9, wherein said counting means further comprises means for moving at least the counting article a predetermined distance laterally with respect to the conveying direction to produce a primary gap on the side of the packaging batch facing the separating part, and wherein said inserting means comprises means for first inserting the separating part into said primary gap to engage and halt at the edge the envelope-like articles upstream of said primary gap, whereupon a secondary gap is formed downstream of the separating part, and means for thereafter inserting the separating part into said secondary gap.

12. A machine as claimed in claim 9, wherein said inserting means further comprises said separating part having a separating point, means for moving the separating point against the edge of the packaging batch in the vicinity of the counting article, means for eccentrically rotating the tip of the point to produce a gap between adjacent envelope-like articles, and means for thereafter inserting the separating part into the gap.

13. A machine as claimed in claim 9, wherein said conveying means comprises two endless delivery belts arranged next to and at a distance from one another, said delivery belts being guided respectively around shafts which are mounted rotatably on a table stand with at least one of shafts being coupled to a drive, said drive of the delivery belts comprising a variable speed continuous drive, and comprising means for setting the conveying speed of the drive to a ratio relative to the conveying speed of the production machine, said setting means comprising a sensor for determining the presence of envelope-like articles being added to the packaging batch for controlling the drive of the belts as a function of increasing size of the packaging batch.

14. A machine as claimed in claim 13, wherein the supporting part comprises two or more strip-shaped supporting elements arranged horizontally and aligned at right angles to the path of movement of the delivery belts, defining between every two adjacent supporting elements an interspace which is open in the direction of the container.

15. A machine as claimed in claim 10, wherein the separating part comprises a separating sword having a wedge-shaped head and a shank adjoining the head, wherein the total length of the separating sword is at least approximately equal to the maximum possible width of the packaging batch, the separating sword having a rest position wherein the tip of its head projects at least partially into the path of movement of the counting article in the packaging batch, and comprising in the region of the tip which projects into the path of movement of the counting article at least one sensor for transmitting a control signal when the counting article approaches and/or comes in contact with the tip.

16. A machine as claimed in claim 15, wherein said inserting means further comprises a delay control means for transmitting a starting signal for driving the separating sword only at a predetermined period of time after the control signal of the sensor at the tip of the separating sword is produced.

17. A machine as claimed in claim 14, wherein the filling means comprises a slide track for the stack which extends from the delivery belts to a filling point of the container, a shifting rake having prongs which extend above or below the supporting elements and/or through the interspace(s) between two mutually adjacent supporting elements, at least to the region of horizontal projection of the separating part; means for guiding the shifting rake transversely relative to the path of movement of the packaging batch; and means for driving the shifting rake from its rest position in which its prongs are located outside the path of movement of the packaging batch, in several stages of movement, at least up to a loading position of the container and then back again into its rest position.

18. A machine as claimed in claim 11, wherein the separating part comprises a separating sword having a wedge-shaped head and a shank adjoining the head, wherein the total length of the separating sword is at least approximately equal to the maximum possible width of the packaging batch, the separating sword having a rest position wherein the tip of its head projects at least near to the path of movement of the packaging batch, the separating sword having in the region of its tip at least one sensor for transmitting a control signal when it encounters the primary gap formed by the counting article.

19. A machine as claimed in claim 18, wherein said inserting means further comprises a cascade circuit means with a delay element, for transmitting a first movement signal for driving the separating sword over a stage of movement reaching into the primary gap of the counting article, and for transmitting a second movement signal for a further stage of movement of the separating sword into its end position following a predetermined period of time after the first movement signal.

20. A machine as claimed in claim 12, wherein said separating part comprises separating lance having a conical head and a circular-cylindrical shank adjoining the head, the total length of the separating lance being at least approximately equal to the maximum possible width of the packaging batch, the separating lance being mounted rotatably about the longitudinal axis of its circular-cylindrical shank and being coupled to a rotary drive, wherein the cone axis of the conical head is offset a certain amount (e) in parallel relative to the axis of the cylindrical shank, and wherein said inserting means further comprises means, including a delay element, for temporarily delaying longitudinal movement of the separating lance toward the packaging batch at that point where the tip of the conical head touches the packaging batch.

21. A machine as claimed in claim 13, wherein the delivery belts extend into a region of horizontal projection of fan disks on the production machine, in a direction counter to the conveying direction of the packaging batch.

22. A machine as claimed in claim 13, wherein the supporting part comprises a longitudinal guide arranged above the plane of the delivery belts, and means for releasing the guide from the table stand together with the delivery belts, and wherein the separating part and the filling means also include means for releasing them from the table stand and are arranged, together with the guide of the supporting part, on a common base stand.

23. A machine as claimed in claim 9, wherein said supporting part comprises at least one sensor arranged on the side facing the stack, the sensors generating a control signal when the packaging batch approaches and/or comes in contact with the supporting part.

24. A machine as claimed in claim 23, comprising two sensors on said supporting part, the sensors being arranged at different heights, with one sensor being in the region of the lower edge of the packaging batch and the other sensor being in the region of the top edge of the packaging batch.

25. A machine as claimed in claim 23, wherein the mean for moving the supporting part comprises a control device arranged above one of the delivery belts on the side of the supporting part facing away from the packaging batch, the control device including a friction wheel having a rotatable mounting which can be lowered on a vertical guide with a vertical until the friction wheel rests on the respective delivery belt, means for pressing the friction wheel against the delivery belt, a control disk connected fixedly in terms of rotation to the friction wheel and having at least two surface regions which are at different distances from a common reference point, a touch-contact switch having a tracer member resting resiliently against one of the two surface regions and being adapted during a rotary movement of the control disk to be moved by these surface regions alternately into an "on" position and into an "off" position of the touch-contact switch, and a control circuit for driving the supporting part, comprising at least a double AND-operator, having a first input terminal connected to the touch-contact switch and a second input terminal connected to one sensor on the supporting part.

26. A machine as claimed in claim 23, wherein said means for moving the supporting part comprises a sensor arranged above one of the delivery belts, on the side of the supporting part facing away from the packaging batch, which sensor responds to markings on the delivery belt and generates control signals, and a control circuit for driving the supporting part, comprising at least a double AND-operator, having a first input terminal connected to the sensor for the markings on the delivery belt and a second input terminal connected to one sensor on the supporting part.

27. A machine as claimed in claim 17, wherein the separating part has, on the side facing the stack support, a longitudinal groove which opens out freely at least at the head end of the separating sword, one of the prongs on the shifting rake is arranged at the height of the longitudinal groove on the separating part and has a length sufficient so that its free end projects into the vertical projection of the longitudinal groove on the separating part.

28. A machine as claimed in claim 15, wherein the separating sword comprises top and bottom parts, arranged above one another and aligned parallel to one another, the two parts being arranged on a common carriage, the bottom part being arranged fixedly at a specific height, the top part being guided on the carriage by means of a vertical guide so as to be adjustable in terms of its height, the device further comprising a lifting means for raising the top part out of a rest position, in which it is adjacent to the bottom part, into an operating position, in which it is a predetermined distance higher than the bottom part, and for lowering it again into the rest position.

29. An automatic packaging machine as claimed in claim 28, wherein the two parts of the separating sword each have, on the side facing the supporting part, a longitudinal groove opening out freely at least at the head end of the separating sword, and one prong on the shifting rake is fixed at the height of the longitudinal groove in the bottom part of the separating sword, whereas another prong on the shifting rake is arranged adjustably at the height of the longitudinal groove in the top part of the separating sword in the operating position, the two prongs having their free ends extending into the vertical projection of the associated longitudinal groove in the bottom part and in the top part of the separating sword, respectively.

30. A machine as claimed in claim 14, wherein the supporting elements of the supporting part extend over and beyond the maximum possible width of the stack into the vicinity of the orifice of the container facing them, and further comprising guide elements positioned in alignment with the supporting elements and in the vertical plane of alignment of the separating part, said guide elements extending at least approximately up to the bottom of a container located in a loading position, wherein, at least one group of the further guide elements is mounted, on their end portion facing away from the container so as to be pivotable about a common vertically aligned pivot axis, and further comprising for each pivotable group of guide elements a spring member biasing the guide elements in the direction of the opposite group of guide elements and against a stop so that they rest at a pivoting angle of about 5° to 10° relative to the alignment of the supporting elements.

31. A machine as claimed in claim 8, further comprising a vibrating device comprising a vibrating table arranged in the region between the alignment of the separating part and the supporting part when fully extended, the vibrating table comprising, transversely relative to the path of movement of the packaging batch, an extension which is at least equal to the maximum width of the packaging batch.

32. A machine as claimed in claim 20, wherein the separating lance comprises a separate conical head and shank parts, the shank being arranged non-rotatably and as a hollow body which has a through-hole extending parallel to the longitudinal axis of the shank, the conical head being mounted rotatably in the shank and being coupled to a rotary drive via a shaft.

33. A machine as claimed in claim 32, wherein the shank has, on the side facing the supporting part, a longitudinal groove which opens out freely at least at the end facing the conical head, and wherein the filling means comprises a shifting rake having one prong fixed at the height of the longitudinal groove in the shank and having its free end extending into the vertical projection of the longitudinal groove in the shank.

34. A machine as claimed in claim 32, further comprising, above the separating lance, a second lance part which is aligned parallel to the separating lance, the second lance part having a length which is at most equal to the length of the cylindrical shank of the separating lance, and a shape, as seen in horizontal projection, which at most extends up to the shape of the separating lance, as seen in horizontal projection, wherein the underside of the second lance part facing the separating lance is matched at least partially to the shape of the top side of the separating lance facing it, and further comprising a vertical guide for guiding the second lance part and means for adjusting the vertical guide in terms of its height relative to the separating lance so that it can be raised out of a position of rest, in which it is adjacent to the separating lance, into an operating position, in which it is a predetermined distance higher than the separating lance, and so that it can be lowered again.

35. A machine as claimed in claim 34, wherein the second lance part has, on the side facing the supporting part, a longitudinal groove which opens out freely at least at the free end of the lance part, and wherein the filling means comprises a shifting rake having one prong arranged adjustably to the height of the longitudinal groove in the second lance part located in the operating position, and having its free end extending into the vertical projection of the longitudinal groove in the second lance part.

36. A machine as claimed in claim 13, further comprising a starting support, a lifting means for raising the starting support from a position of rest, wherein the starting support is being below the plane of the delivery belts, into and operating position, extending to a height which is at least approximately equal to some of the height of the packaging batch, the starting support including a longitudinal guide along which it is movable parallel to the delivery belts between an initial position located in the vicinity of the production machine, and an end position located in an initial position of the supporting part, means for moving the starting support in the direction of movement of the packaging batch at least approximately at the speed of movement of the delivery belts, and means for moving the starting support back in the opposite direction of movement independently.

37. A machine as claimed in claim 9, further comprising means for moving the supporting part to the separation point and retracting the separating part out of the path of movement of the upstream portion of the packaging batch, after the stack has been transferred into the container.

38. A process for packaging into a container envelope-like articles which exit serially from a production machine, comprising the steps of:

serially collecting a packaging batch comprising a plurality of envelope-like articles;

counting the envelope-like articles to identify periodically an individual article of the packaging batch which corresponds to a specific batch size of a stack to be packaged, said individual article constituting a counting article;

conveying the packaging batch at least semi-continuously in a conveying direction in relation to the further individual articles which are supplied to the packaging batch;

moving a supporting part in the conveying direction in front of the head of the packaging batch at a speed equal to supply of the further individual articles to the packaging batch to thereby keep the batch at least approximately vertical;

when the counting article arrives at a separation point located at a predetermined distance in the conveying direction, inserting a separating part transversely relative to the conveying direction of the batch between adjacent envelope-like articles at least in the vicinity of the counting article, to define the stack and temporarily stop a portion of the packaging batch upstream of the stack;

after the separating part has been inserted between the stack and the upstream portion of the packaging batch, moving the supporting part a predetermined distance in a direction opposite to the conveying direction to thereby compress the stack to a stack length which is less than the horizontally measured width of the container;

filling the compressed stack into the container in a direction transverse to the conveying direction;

after the stack has been transferred into the container, moving the supporting part to the separation point and retracting the separating part out of the path of movement of the upstream portion of the packaging batch; and wherein said inserting step further comprises moving a separating point of the separating part against one edge of the packaging batch in the vicinity of the counting article, eccentrically rotating the tip of said point to produce a gap between adjacent envelope-like articles, and thereafter inserting the separating part into said gap.

39. A process as claimed in claim 38, further comprising the steps of pushing the container onto guide elements which are arranged in alignment with the separating part, moving the stack during said filling step a distance which exceed the container depth by an amount sufficient to push the container, together with the stack, off from the guide elements, and thereafter conveying the filled container away from the point of filling.

40. A process as claimed in claim 38, further comprising the step of vibrating in a vertical direction the stack during at least the first portion of said step of filling the container and contacting the stack on the side facing away from the container to align all edges of the envelop-like articles flush.

41. A process as claimed in claim 40, wherein said vibrating step further comprises, at the start of the vibrating step, moving the supporting part a certain distance away from the separating part, and thereafter, during or after the vibration phase, moving the supporting part in the direction of the separating part to thereby again compress the stack.

* * * * *